US009526956B2

(12) United States Patent
Murphy et al.

(10) Patent No.: US 9,526,956 B2
(45) Date of Patent: Dec. 27, 2016

(54) GOLF CLUB HEAD

(71) Applicant: Acushnet Company, Fairhaven, MA (US)

(72) Inventors: Stephen S. Murphy, Carlsbad, CA (US); Darryl C. Galvan, El Cajon, CA (US); Richard L. Cleghorn, Carlsbad, CA (US); Grant M. Martens, Carlsbad, CA (US); David S. Cornelius, Oceanside, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/814,334

(22) Filed: Jul. 30, 2015

(65) Prior Publication Data

US 2016/0067563 A1 Mar. 10, 2016

Related U.S. Application Data

(63) Continuation-in-part of application No. 14/479,002, filed on Sep. 5, 2014.

(51) Int. Cl.

| | |
|---|---|
| ***A63B 53/04*** | (2015.01) |
| ***A63B 59/00*** | (2015.01) |
| ***A63B 53/06*** | (2015.01) |

(52) U.S. Cl.

CPC .... *A63B 53/0466* (2013.01); *A63B 2053/0408* (2013.01); *A63B 2053/0433* (2013.01);

(Continued)

(58) Field of Classification Search

CPC ..... A63B 53/04; A63B 59/00; A63B 49/06; A63B 53/06

(Continued)

(56) References Cited

U.S. PATENT DOCUMENTS

| | | | |
|---|---|---|---|
| 819,900 | A | 5/1906 | Martin |
| 1,705,997 | A | 3/1929 | Quynn |

(Continued)

FOREIGN PATENT DOCUMENTS

| | | |
|---|---|---|
| JP | 1091876 | 4/1989 |
| JP | 1259876 | 10/1989 |

(Continued)

OTHER PUBLICATIONS

English language translation of JP Patent Publication No. 2002-52099 (full text).

(Continued)

*Primary Examiner* — William Pierce
(74) *Attorney, Agent, or Firm* — Randy K. Chang

(57) ABSTRACT

A golf club head comprising a variable thickness profile comprising a thick central portion; a transition portion; and a thin perimeter portion; wherein said transition portion surrounds said thick central portion; wherein said thin perimeter portion surrounds said transition portion; wherein said thick central portion comprises a center, said center of said thick central portion located equidistant from a heel most portion of said thick central portion and a toe most portion of said thick central portion; wherein said center of said thick central portion is offset from said geometric center of said striking face. The present invention also discloses a flexure feature located near a frontal sole portion of the golf club head, wherein the flexure has a specific thickness profile adapted to respond to the needs of the present golf club head.

7 Claims, 14 Drawing Sheets

(52) U.S. Cl.
CPC ..... *A63B 2053/0437* (2013.01); *A63B 2053/0458* (2013.01); *A63B 2053/0462* (2013.01); *A63B 2053/0491* (2013.01)

(58) Field of Classification Search
USPC ..... 473/329, 342, 349
See application file for complete search history.

(56) References Cited

U.S. PATENT DOCUMENTS

| | | | |
|---|---|---|---|
| 2,968,486 | A | 1/1961 | Walton |
| 3,084,940 | A | 4/1963 | Cissel |
| 3,166,320 | A | 1/1965 | Onions |
| 3,957,194 | A | 5/1976 | Woodward |
| 3,975,023 | A | 8/1976 | Inamori |
| 4,027,885 | A | 6/1977 | Rogers |
| 4,139,196 | A | 2/1979 | Riley |
| 4,220,276 | A | 9/1980 | Weisert et al. |
| 4,420,156 | A | 12/1983 | Campau |
| 4,471,961 | A | 9/1984 | Masghati et al. |
| 4,575,447 | A | 3/1986 | Hariguchi |
| 4,603,808 | A | 8/1986 | Stacher |
| 4,754,974 | A | 7/1988 | Kobayashi |
| 5,076,585 | A | 12/1991 | Bouquet |
| D323,035 | S | 1/1992 | Yang |
| 5,092,599 | A | 3/1992 | Okumoto et al. |
| 5,094,457 | A | 3/1992 | Kinoshita |
| 5,193,810 | A | 3/1993 | Antonious |
| 5,205,560 | A | 4/1993 | Hoshi et al. |
| 5,221,086 | A | 6/1993 | Antonious |
| 5,228,615 | A | 7/1993 | Iijima et al. |
| 5,299,807 | A | 4/1994 | Hutin |
| 5,346,216 | A | 9/1994 | Aizawa |
| 5,366,223 | A | 11/1994 | Werner et al. |
| 5,429,357 | A | 7/1995 | Kobayashi |
| D366,508 | S | 1/1996 | Hutin |
| 5,492,327 | A | 2/1996 | Biafore, Jr. |
| 5,511,786 | A | 4/1996 | Antonious |
| D372,512 | S | 8/1996 | Simmons |
| D375,130 | S | 10/1996 | Hlinka et al. |
| 5,584,770 | A | 12/1996 | Jensen |
| D377,509 | S | 1/1997 | Katayama |
| D378,770 | S | 4/1997 | Hlinka et al. |
| 5,616,088 | A | 4/1997 | Aizawa et al. |
| 5,632,695 | A | 5/1997 | Hlinka |
| 5,643,108 | A | 7/1997 | Cheng |
| D382,612 | S | 8/1997 | Oyer |
| 5,669,827 | A | 9/1997 | Nagamoto |
| 5,681,228 | A | 10/1997 | Mikame et al. |
| D394,688 | S | 5/1998 | Fox |
| 5,772,527 | A | 6/1998 | Liu |
| D397,750 | S | 9/1998 | Frazetta |
| 5,839,975 | A | 11/1998 | Lundberg |
| D403,037 | S | 12/1998 | Stone et al. |
| D405,488 | S | 2/1999 | Burrows |
| 5,944,620 | A | 8/1999 | Elmer |
| D413,952 | S | 9/1999 | Oyer |
| 5,954,596 | A | 9/1999 | Noble et al. |
| 5,971,867 | A | 10/1999 | Galy |
| 5,993,329 | A | 11/1999 | Shieh |
| 5,993,331 | A | 11/1999 | Shieh |
| 6,007,432 | A | 12/1999 | Kosmatka |
| 6,017,280 | A | 1/2000 | Hubert |
| 6,033,319 | A | 3/2000 | Farrar |
| 6,042,486 | A | 3/2000 | Gallagher |
| 6,048,278 | A | 4/2000 | Meyer et al. |
| 6,074,308 | A | 6/2000 | Domas |
| 6,077,172 | A | 6/2000 | Butler |
| 6,086,485 | A | 7/2000 | Hamada et al. |
| 6,123,627 | A | 9/2000 | Antonious |
| 6,152,833 | A | 11/2000 | Werner et al. |
| 6,183,377 | B1 | 2/2001 | Liang |
| 6,183,381 | B1 | 2/2001 | Grant et al. |
| 6,217,461 | B1 | 4/2001 | Galy |
| 6,319,149 | B1 | 11/2001 | Lee |
| 6,319,150 | B1 | 11/2001 | Werner et al. |
| 6,344,001 | B1 | 2/2002 | Hamada |
| 6,348,013 | B1 | 2/2002 | Kosmatka |
| 6,354,961 | B1 | 3/2002 | Allen |
| 6,354,962 | B1 | 3/2002 | Galloway et al. |
| 6,368,232 | B1 | 4/2002 | Hamada et al. |
| 6,368,234 | B1 | 4/2002 | Galloway |
| 6,381,828 | B1 | 5/2002 | Boyce et al. |
| 6,390,932 | B1 | 5/2002 | Kosmatka et al. |
| 6,390,933 | B1 | 5/2002 | Galloway et al. |
| 6,398,666 | B1 | 6/2002 | Evans et al. |
| 6,425,832 | B2 | 7/2002 | Cackett et al. |
| 6,491,592 | B2 | 12/2002 | Cackett et al. |
| 6,506,129 | B2 | 1/2003 | Chen |
| 6,508,722 | B1 | 1/2003 | McCabe et al. |
| 6,524,194 | B2 | 2/2003 | McCabe |
| 6,530,847 | B1 | 3/2003 | Antonious |
| 6,558,272 | B2 | 5/2003 | Helmstetter et al. |
| 6,595,869 | B2 | 7/2003 | McCabe et al. |
| 6,602,149 | B1 | 8/2003 | Jacobson |
| 6,607,452 | B2 | 8/2003 | Helmstetter et al. |
| D482,089 | S | 11/2003 | Burrows |
| D482,090 | S | 11/2003 | Burrows |
| D482,420 | S | 11/2003 | Burrows |
| D484,208 | S | 12/2003 | Burrows |
| 6,663,506 | B2 | 12/2003 | Nishimoto |
| 6,679,782 | B2 | 1/2004 | Tang et al. |
| 6,679,786 | B2 | 1/2004 | McCabe |
| D486,542 | S | 2/2004 | Burrows |
| 6,695,715 | B1 | 2/2004 | Chikaraishi |
| 6,716,110 | B1 | 4/2004 | Ballow |
| 6,719,644 | B2 | 4/2004 | Beach |
| 6,719,645 | B2 | 4/2004 | Kouno |
| 6,739,984 | B1 | 5/2004 | Ciasullo |
| 6,743,118 | B1 | 6/2004 | Soracco |
| 6,783,465 | B2 | 8/2004 | Matsunaga |
| 6,783,466 | B2 | 8/2004 | Seki et al. |
| 6,824,475 | B2 | 11/2004 | Burnett et al. |
| D501,036 | S | 1/2005 | Burrows |
| D501,523 | S | 2/2005 | Dogan et al. |
| D501,903 | S | 2/2005 | Tanaka |
| 6,855,068 | B2 | 2/2005 | Antonious |
| D504,478 | S | 4/2005 | Burrows |
| 6,875,129 | B2 | 4/2005 | Erickson et al. |
| 6,878,073 | B2 | 4/2005 | Takeda |
| 6,880,222 | B2 | 4/2005 | Matsunaga |
| 6,887,165 | B2 | 5/2005 | Tsurumaki |
| D506,236 | S | 6/2005 | Evans et al. |
| D508,274 | S | 8/2005 | Burrows |
| 6,932,716 | B2 | 8/2005 | Ehlers et al. |
| 6,955,612 | B2 | 10/2005 | Lu |
| 6,979,270 | B1 | 12/2005 | Allen |
| 6,991,558 | B2 | 1/2006 | Beach et al. |
| 6,997,821 | B2 | 2/2006 | Galloway et al. |
| 7,029,403 | B2 | 4/2006 | Rice et al. |
| D520,585 | S | 5/2006 | Hasebe |
| D523,104 | S | 6/2006 | Hasebe |
| 7,086,962 | B2 | 8/2006 | Galloway et al. |
| 7,097,572 | B2 | 8/2006 | Yabu |
| 7,140,974 | B2 | 11/2006 | Chao et al. |
| 7,147,575 | B2 | 12/2006 | Galloway et al. |
| 7,153,221 | B2 | 12/2006 | Hocknell et al. |
| 7,156,750 | B2 | 1/2007 | Nishitani et al. |
| 7,166,038 | B2 | 1/2007 | Williams et al. |
| 7,169,060 | B2 | 1/2007 | Stevens et al. |
| D536,402 | S | 2/2007 | Kawami |
| 7,182,699 | B2 | 2/2007 | Matsunaga |
| 7,198,575 | B2 | 4/2007 | Beach et al. |
| 7,204,768 | B2 | 4/2007 | Nakahara et al. |
| 7,207,898 | B2 | 4/2007 | Rice et al. |
| 7,211,006 | B2 | 5/2007 | Chang |
| 7,220,190 | B2 | 5/2007 | Hirano |
| 7,226,366 | B2 | 6/2007 | Galloway |
| 7,241,230 | B2 | 7/2007 | Tsunoda et al. |
| 7,258,626 | B2 | 8/2007 | Gibbs et al. |
| D552,701 | S | 10/2007 | Ruggiero et al. |
| 7,294,064 | B2 | 11/2007 | Tsurumaki et al. |
| 7,318,782 | B2 | 1/2008 | Imamoto et al. |
| 7,331,877 | B2 | 2/2008 | Yamaguchi et al. |
| 7,344,452 | B2 | 3/2008 | Imamoto et al. |

(56) References Cited

U.S. PATENT DOCUMENTS

| | | | | |
|---|---|---|---|---|
| 7,347,795 | B2 | 3/2008 | Yamagishi et al. | |
| 7,347,796 | B2 | 3/2008 | Takeda | |
| 7,361,099 | B2 | 4/2008 | Rice et al. | |
| 7,367,899 | B2 | 5/2008 | Rice et al. | |
| 7,410,428 | B1 | 8/2008 | Dawson et al. | |
| 7,413,517 | B2 | 8/2008 | Butler, Jr. et al. | |
| 7,413,519 | B1 | 8/2008 | Dawson et al. | |
| 7,413,520 | B1 | 8/2008 | Hocknell et al. | |
| 7,419,442 | B1 | 9/2008 | Alan et al. | |
| 7,431,666 | B2 | 10/2008 | Vincent et al. | |
| 7,431,667 | B2 | 10/2008 | Vincent et al. | |
| 7,438,649 | B2 | 10/2008 | Ezaki et al. | |
| 7,470,201 | B2 | 12/2008 | Nakahara et al. | |
| 7,497,789 | B2 | 3/2009 | Burnett et al. | |
| 7,500,924 | B2 * | 3/2009 | Yokota | A63B 53/0466 473/332 |
| 7,530,901 | B2 | 5/2009 | Imamoto et al. | |
| 7,530,903 | B2 | 5/2009 | Imamoto et al. | |
| 7,549,934 | B2 | 6/2009 | Rice | |
| 7,549,935 | B2 | 6/2009 | Foster et al. | |
| 7,572,193 | B2 | 8/2009 | Yokota et al. | |
| 7,582,024 | B2 | 9/2009 | Shear | |
| 7,585,233 | B2 | 9/2009 | Horacek et al. | |
| 7,591,737 | B2 | 9/2009 | Gibbs et al. | |
| 7,632,193 | B2 | 12/2009 | Thielen | |
| 7,682,263 | B2 | 3/2010 | Yamamoto | |
| 7,682,264 | B2 | 3/2010 | Hsu et al. | |
| 7,704,162 | B2 | 4/2010 | Rice et al. | |
| 7,717,806 | B2 | 5/2010 | Kubota | |
| D616,952 | S | 6/2010 | Oldknow | |
| 7,749,097 | B2 | 7/2010 | Foster et al. | |
| 7,753,807 | B2 | 7/2010 | Nakano | |
| 7,758,454 | B2 | 7/2010 | Burnett et al. | |
| 7,762,907 | B2 | 7/2010 | Rice | |
| 7,775,903 | B2 | 8/2010 | Kawaguchi et al. | |
| 7,850,544 | B2 | 12/2010 | Meyer et al. | |
| 7,857,711 | B2 | 12/2010 | Shear | |
| 7,874,938 | B2 | 1/2011 | Chao | |
| 7,896,753 | B2 | 3/2011 | Boyd et al. | |
| 7,934,998 | B2 | 5/2011 | Yokota | |
| 7,980,963 | B2 | 7/2011 | Rice et al. | |
| 8,025,591 | B2 | 9/2011 | De La Cruz et al. | |
| 8,038,544 | B2 | 10/2011 | Meyer et al. | |
| 8,152,652 | B2 | 4/2012 | Curtis et al. | |
| 8,235,841 | B2 | 8/2012 | Stites et al. | |
| 8,235,844 | B2 | 8/2012 | Albertsen et al. | |
| 8,241,143 | B2 | 8/2012 | Albertsen et al. | |
| 8,241,144 | B2 | 8/2012 | Albertsen et al. | |
| 8,262,501 | B2 | 9/2012 | Curtis et al. | |
| 8,267,808 | B2 | 9/2012 | De La Cruz et al. | |
| 8,303,432 | B2 | 11/2012 | Curtis et al. | |
| 8,403,771 | B1 | 3/2013 | Rice et al. | |
| 8,419,569 | B2 | 4/2013 | Bennett et al. | |
| 8,430,763 | B2 | 4/2013 | Beach et al. | |
| 8,517,860 | B2 | 8/2013 | Albertsen et al. | |
| 8,529,368 | B2 | 9/2013 | Rice et al. | |
| 8,986,133 | B2 * | 3/2015 | Bennett | A63B 59/0092 473/329 |
| 9,211,448 | B2 * | 12/2015 | Bezilla | A63B 53/06 |
| 2005/0049081 | A1 | 3/2005 | Boone | |
| 2005/0059508 | A1 | 3/2005 | Burnett et al. | |
| 2007/0026961 | A1 * | 2/2007 | Hou | A63B 53/0466 473/329 |
| 2007/0082751 | A1 | 4/2007 | Lo | |
| 2007/0275791 | A1 | 11/2007 | Shear | |
| 2010/0105501 | A1 | 4/2010 | Wada et al. | |
| 2010/0255930 | A1 | 10/2010 | Rice et al. | |
| 2011/0319188 | A1 | 12/2011 | Narita et al. | |
| 2012/0034991 | A1 | 2/2012 | Hartwell et al. | |
| 2012/0142452 | A1 | 6/2012 | Burnett et al. | |
| 2012/0196701 | A1 | 8/2012 | Stites | |
| 2012/0202615 | A1 | 8/2012 | Beach et al. | |
| 2012/0244960 | A1 | 9/2012 | Tang et al. | |
| 2012/0270676 | A1 | 10/2012 | Burnett | |
| 2012/0277029 | A1 | 11/2012 | Albertsen | |
| 2012/0277030 | A1 | 11/2012 | Albertsen | |
| 2012/0289361 | A1 | 11/2012 | Beach et al. | |
| 2013/0165252 | A1 | 6/2013 | Rice et al. | |
| 2013/0165254 | A1 | 6/2013 | Rice et al. | |
| 2013/0184100 | A1 | 7/2013 | Burnett et al. | |
| 2013/0210542 | A1 | 8/2013 | Harbert et al. | |
| 2014/0080634 | A1 | 3/2014 | Golden | |

FOREIGN PATENT DOCUMENTS

| | | |
|---|---|---|
| JP | 4-347179 | 12/1992 |
| JP | 7-155410 | 6/1995 |
| JP | 9-51968 | 2/1997 |
| JP | 9-215786 | 8/1997 |
| JP | 11-114107 | 4/1999 |
| JP | 11-114112 | 4/1999 |
| JP | 11-178955 | 7/1999 |
| JP | 2000-126339 | 5/2000 |
| JP | 2000-176056 | 6/2000 |
| JP | 2000-262656 | 9/2000 |
| JP | 2002-52099 | 2/2002 |
| JP | 2003-062135 | 3/2003 |
| JP | 2003-093554 | 4/2003 |
| JP | 2003-190340 | 7/2003 |
| JP | 2003-265657 | 9/2003 |
| JP | 2003-290397 | 10/2003 |
| JP | 2004-121395 | 4/2004 |
| JP | 2004-174224 | 6/2004 |
| JP | 2004-261451 | 9/2004 |
| JP | 2004-313762 | 11/2004 |
| JP | 2004-351054 | 12/2004 |
| JP | 2004-351173 | 12/2004 |
| JP | 2005-576 | 1/2005 |
| JP | 2005-177092 | 7/2005 |
| WO | WO 2007-136069 | 6/2007 |

OTHER PUBLICATIONS

Procedure for Measuring the Flexibility of a Golf Clubhead, Revision 2.0, Mar. 25, 2005 by the United States Golf Association.

* cited by examiner

GOLF CLUB HEAD

CROSS REFERENCE TO RELATED APPLICATIONS

This application is a Continuation-In-Part (CIP) of U.S. patent application Ser. No. 14/479,002, filed Sep. 5, 2014, the disclosure of which is disclosed by reference in its entirety.

TECHNICAL FIELD

This present technology generally relates to golf clubs, and more specifically to golf club heads having an improved sweet spot concentrated about the geometric center of the golf club head. Moreover, the present technology also utilizes a flexure at either the sole or crown portion of the golf club head to improve the compliance of the striking face of the golf club head.

DESCRIPTION OF THE RELATED TECHNOLOGY

In the competitive industry of golf club design, distance and accuracy are two of the most important performance factors that help define the desirability of a metal wood type golf club. Although some may argue that the look, feel, and sound of a golf club may influence their opinion of a golf club; there is no arguing that the performance factors play a major role in determining the desirability of a golf club. The performance factors of maximizing distance while maintaining accuracy becomes even more prevalent in a metal wood type golf club head. Unlike iron type golf club heads where accuracy of a golf shot clearly trumps the distance benefits gained by any individual golf club, metal wood type golf club heads are designed to allow a golfer to hit the golf ball as far as possible and as straight as possible.

In order to maximize distance while maintaining accuracy of a metal wood type golf club head, metal wood type golf clubs have been designed with the objective of maximizing the distance of a golf ball struck by a golf club head close to the geometric center of the golf club head. This geometric center of the golf club head, due to the inherent laws of physics, may generally produce a golf shot that maximizes the distance by reducing the energy loss between the golf ball and the golf club head. In order to quantify this value, the United States Golf Association (USGA), in conjunction with the golfing industry, have come up with various methods such as the calculation the Coefficient of Restitution (COR) or the calculation of the Characteristic Time (CT) as ways to quantify the rebounding characteristic of a golf ball after it impacts a golf club head.

U.S. Pat. No. 6,390,933 to Galloway et al. ('933 patent) discusses one of the methods to increase the COR of a golf club head by disclosing a golf club head having a coefficient of restitution greater than 0.845 and a durability to withstand 2000 impacts with a golf ball at 110 miles per hour, wherein the club head may be composed of three pieces, a face, a sole, and a crown. More specifically, the '933 patent discloses a golf club head that may be composed of a titanium material, having a volume in the range of 175 cubic centimeters to 400 cubic centimeters, a weight in the range of 165 grams to 300 grams, and a striking plate surface area in the range of 4.00 square inches to 7.50 square inches.

Focusing on accuracy instead of distance, U.S. Patent Publication No. 2004/0116202 to Lin ('202 patent Publication), discusses a method to increase the accuracy of a golf club head by disclosing a golf club head having a plurality of holes around the periphery of the club head, so that when the club head hits the golf ball, most of the vibration waves and sound waves generated are dispersed out of these holes thus improving accuracy of the direction of the striking golf ball.

However, upon closer examination, we can see that developments in maximizing distance while maintaining accuracy of a metal wood type golf club head are premised upon the fact that the golfer be capable of hitting the golf ball at the sweet spot. It may be difficult for the average golfer to consistently strike a golf ball in the sweet spot. Hence, in addition to the performance factors mentioned above, it may also be desirable to optimize the size and location of this sweet spot, so an average golfer may obtain the design benefits of maximizing the distance and accuracy of the golf club head.

SUMMARY

The systems, methods, and devices described herein have innovative aspects, no single one of which is indispensable or solely responsible for their desirable attributes. Without limiting the scope of the claims, some of the advantageous features will now be summarized.

One aspect of the present technology is the realization that some golf club head constructions produce a sweet spot which is offset from the geometric center of the striking face. Thus, there exists a need for an improved golf club head construction which can utilize innovating features while focusing the sweet spot about the geometric center of the striking face. Embodiments disclosed herein provide golf club head constructions which improve the performance of golf club heads.

One non-limiting embodiment of the present technology includes a golf club head comprising a striking face; a posterior body portion comprising a crown portion and a sole portion, wherein said crown portion is coupled to an upper portion of said striking face and said sole portion is coupled to a lower portion of said striking face: wherein said striking face comprises: a heel side and a toe side; a major axis located on said striking face and oriented substantially from said heel side towards said toe side, wherein said major axis is the longest line that can be drawn on said striking face; a minor axis located on said striking face and oriented substantially from said crown portion towards said sole portion, wherein said minor axis is the longest line perpendicular to said major axis that can be drawn on said striking face; a variable thickness profile comprising: a thick central portion; a transition portion; and a thin perimeter portion; wherein said transition portion surrounds said thick central portion; wherein said thin perimeter portion surrounds said transition portion; wherein said thick central portion comprises a center, said center of said thick central portion located equidistant along an axis parallel to said major axis from a heel most portion of said thick central portion and a toe most portion of said thick central portion; wherein said center of said thick central portion is offset from a geometric center of said striking face along an axis parallel to said major axis.

In an additional non-limiting embodiment of the present technology said center of said thick central portion is offset from said geometric center towards said toe side of said striking face at least 2 mm.

In an additional non-limiting embodiment of the present technology said center of said thick central portion is offset from said geometric center towards said toe side of said striking face at least 3 mm and less than 7 mm.

In an additional non-limiting embodiment of the present technology said center of said thick central portion is offset from said geometric center towards said toe side of said striking face at least 4 mm and less than 6 mm.

In an additional non-limiting embodiment of the present technology a distance H from said center of said thick central portion to a heel most portion of said transition portion is at least 1 mm longer than a distance G from said center of said thick central portion to a toe most portion of said transition portion, wherein said distance H and said distance G are each measured along an axis parallel to said major axis.

In an additional non-limiting embodiment of the present technology said striking face comprises a sweet spot, said sweet spot defined by the portion of said striking face capable of producing at least 99.7% of the maximum resultant ball speed achievable when a golf ball strikes said striking face, wherein said sweet spot is substantially centered about said geometric center of said striking face.

In an additional non-limiting embodiment of the present technology $|(CT_{Toe\text{-}0.5''}/CT_{Center})-1|\leq 0.06$ and $|(CT_{Heel\text{-}0.5''}/CT_{Center})-1|\leq 0.06$, wherein $CT_{Center}$ is the CT measurement at said geometric center of said striking face, $CT_{Toe\text{-}0.5''}$ is the CT measurement at a point offset 0.5" towards said toe side from said geometric center along an axis parallel to said major axis, and $CT_{Heel\text{-}0.5''}$ is the CT measurement at a point offset 0.5" towards said heel side from said geometric center along an axis parallel to said major axis.

In an additional non-limiting embodiment of the present technology said thick central portion is substantially elliptical in shape and substantially constant in thickness, and wherein said geometric center of said striking face is located at a midpoint of said minor axis.

An additional non-limiting embodiment of the present technology includes a golf club head comprising: a striking face; a posterior body portion further comprising a crown portion and a sole portion, wherein said crown portion is coupled to an upper portion of said striking face and said sole portion is coupled to a lower portion of said striking face; wherein said striking face comprises: a heel side and a toe side; a major axis located on said striking face and oriented substantially from said heel side towards said toe side, wherein said major axis is the longest line that can be drawn on said striking face; a minor axis located on said striking face and oriented substantially from said crown portion towards said sole portion, wherein said minor axis is the longest line perpendicular to said major axis that can be drawn on said striking face; a variable thickness profile comprising: a thick central portion; a transition portion; and a thin perimeter portion; wherein said transition portion surrounds said thick central portion; wherein said thin perimeter portion surrounds said transition portion; wherein said thick central portion comprises a center, said center of said thick central portion located equidistant along an axis parallel to said major axis from a heel most portion of said thick central portion and a toe most portion of said thick central portion; wherein said sole portion further comprises a flexure spaced from said striking face, said flexure comprising a front wall, an apex, and a rear wall, wherein said front wall and said rear wall both extend into an interior of said golf club head, and wherein said front wall and said rear wall are coupled at said apex; wherein said flexure is offset from a geometric center of said striking face along an axis parallel to said major axis; wherein said center of said thick central portion is offset from said geometric center of said striking face along an axis parallel to said major axis in substantially the same direction as said flexure.

In an additional non-limiting embodiment of the present technology said flexure comprises a center, said center of said flexure located equidistant along an axis parallel to said major axis from a heel most portion of said flexure and a toe most portion of said flexure, said center of said flexure offset at least 2 mm from said geometric center of said golf club, and wherein said center of said thick central portion of said striking face is offset at least 2 mm from said geometric center of said golf club.

In an additional non-limiting embodiment of the present technology center of said flexure is offset at least 3 mm and less than 7 mm from said geometric center, and wherein said center of said thick central portion is offset at least 3 mm and less than 7 mm from said geometric center.

In an additional non-limiting embodiment of the present technology said center of said flexure and said center of said thick central portion are offset substantially the same distance from said geometric center along an axis parallel to said major axis.

In an additional non-limiting embodiment of the present technology flexure and said thick central portion are both offset towards said toe side of said striking face.

In an additional non-limiting embodiment of the present technology said striking face comprises a sweet spot, said sweet spot defined by the portion of said striking face capable of producing at least 99.7% of the maximum resultant ball speed achievable when a golf ball strikes said striking face, wherein said sweet spot is substantially centered about said geometric center of said striking face.

In an additional non-limiting embodiment of the present technology $|(CT_{Toe\text{-}0.5''}/CT_{Center})-1|\leq 0.06$ and $|(CT_{Heel\text{-}0.5''}/CT_{Center})-1|\leq 0.06$, wherein $CT_{Center}$ is the CT measurement at said geometric center of said striking face, $CT_{Toe\text{-}0.5''}$ is the CT measurement at a point offset 0.5" towards said toe side from said geometric center along an axis parallel to said major axis, and $CT_{Heel\text{-}0.5''}$ is the CT measurement at a point offset 0.5" towards said heel side from said geometric center along an axis parallel to said major axis.

In an additional non-limiting embodiment of the present technology said thick central portion is substantially elliptical in shape and substantially constant in thickness, and wherein said geometric center of said striking face is located at a midpoint of said minor axis.

An additional non-limiting embodiment of the present technology includes a golf club head comprising: a striking face; a posterior body portion further comprising a crown portion and a sole portion, wherein said crown portion is coupled to an upper portion of said striking face and said sole portion is coupled to a lower portion of said striking face; wherein said striking face comprises: a heel side and a toe side; a major axis located on said striking face and oriented substantially from said heel side towards said toe side, wherein said major axis is the longest line that can be drawn on said striking face; a minor axis located on said striking face and oriented substantially from said crown portion towards said sole portion, wherein said minor axis is the longest line perpendicular to said major axis that can be drawn on said striking face; a variable thickness profile comprising: a thick central portion; a transition portion; and a thin perimeter portion; wherein said transition portion surrounds said thick central portion; wherein said thin perimeter portion surrounds said transition portion; wherein said thick central portion comprises a center, said center of said thick central portion located equidistant along an axis parallel to said major axis from a heel most portion of said thick central portion and a toe most portion of said thick central portion; wherein said sole portion further comprises a flexure spaced from said striking face, said flexure comprising a front wall, an apex, and a rear wall, wherein said front wall and said rear wall both extend into an interior of said golf club head, and wherein said front wall and said rear wall are coupled at said apex; wherein said flexure comprises a toe portion toeward of a geometric center of said striking face and a heel portion heelward of said geometric center; wherein either said toe portion of said flexure or said heel portion of said flexure is more compliant than the opposite portion; wherein said center of said thick central portion is offset along an axis parallel to said major axis towards the more compliant portion of said flexure.

In an additional non-limiting embodiment of the present technology said center of said thick central portion of said striking face is offset at least 2 mm from said geometric center.

In an additional non-limiting embodiment of the present technology said center of said thick central portion is offset at least 3 mm and less than 7 mm from said geometric center.

In an additional non-limiting embodiment of the present technology wherein said center of said thick central portion is offset at least 4 mm and less than 6 mm from said geometric center.

In an additional non-limiting embodiment of the present technology said striking face comprises a sweet spot, said sweet spot defined by the portion of said striking face capable of producing at least 99.7% of the maximum resultant ball speed achievable when a golf ball strikes said striking face, wherein said sweet spot is substantially centered about said geometric center of said striking face.

In an additional non-limiting embodiment of the present technology $|(CT_{Toe\text{-}0.5''}/CT_{Center})-1|\leq 0.06$ and $|(CT_{Heel\text{-}0.5''}/CT_{Center})-1|\leq 0.06$, wherein $CT_{Center}$ is the CT measurement at said geometric center of said striking face, $CT_{Toe\text{-}0.5''}$ is the CT measurement at a point offset 0.5" towards said toe side from said geometric center along an axis parallel to said major axis, and $CT_{Heel\text{-}0.5''}$ is the CT measurement at a point offset 0.5" towards said heel side from said geometric center along an axis parallel to said major axis.

In an additional non-limiting embodiment of the present technology said thick central portion is substantially elliptical in shape and substantially constant in thickness, wherein said geometric center of said striking face is located at a midpoint of said minor axis, and wherein said thick central portion is offset towards said toe side of said striking face from said geometric center.

In an additional non-limiting embodiment of the present invention the front wall of the flexure has a wall thickness greater than or equal to the rear wall thickness of the flexure, and the apex of the flexure has a wall thickness greater than or equal to the rear wall thickness In an additional non-limiting embodiment of the present invention the sole portion further comprises of a flexure spaced from said striking face. The flexure further comprises of a central portion, located near a geometric center of the striking face, a plurality of two or more intermediate transition regions, located nears a toe portion and a heel portion of the central portion; and a plurality of two or more outer transition regions, located near a toe and a heel portion of the plurality of two or more intermediate transition regions. The central portion further comprises of a front wall, a rear wall, and an apex, and the front wall has a wall thickness greater than a wall thickness of the rear wall, the rear wall has a wall thickness greater than a wall thickness of the plurality of two or more intermediate transition regions, and the plurality of two or more intermediate transition regions has a wall thickness greater than a wall thickness of the plurality of two or more outer transition regions

BRIEF DESCRIPTION OF THE DRAWINGS

The accompanying drawings form a part of the specification and are to be read in conjunction therewith. The illustrated embodiments, however, are merely examples and are not intended to be limiting. Like reference numbers and designations in the various drawings indicate like elements.

DETAILED DESCRIPTION

Figure 1:
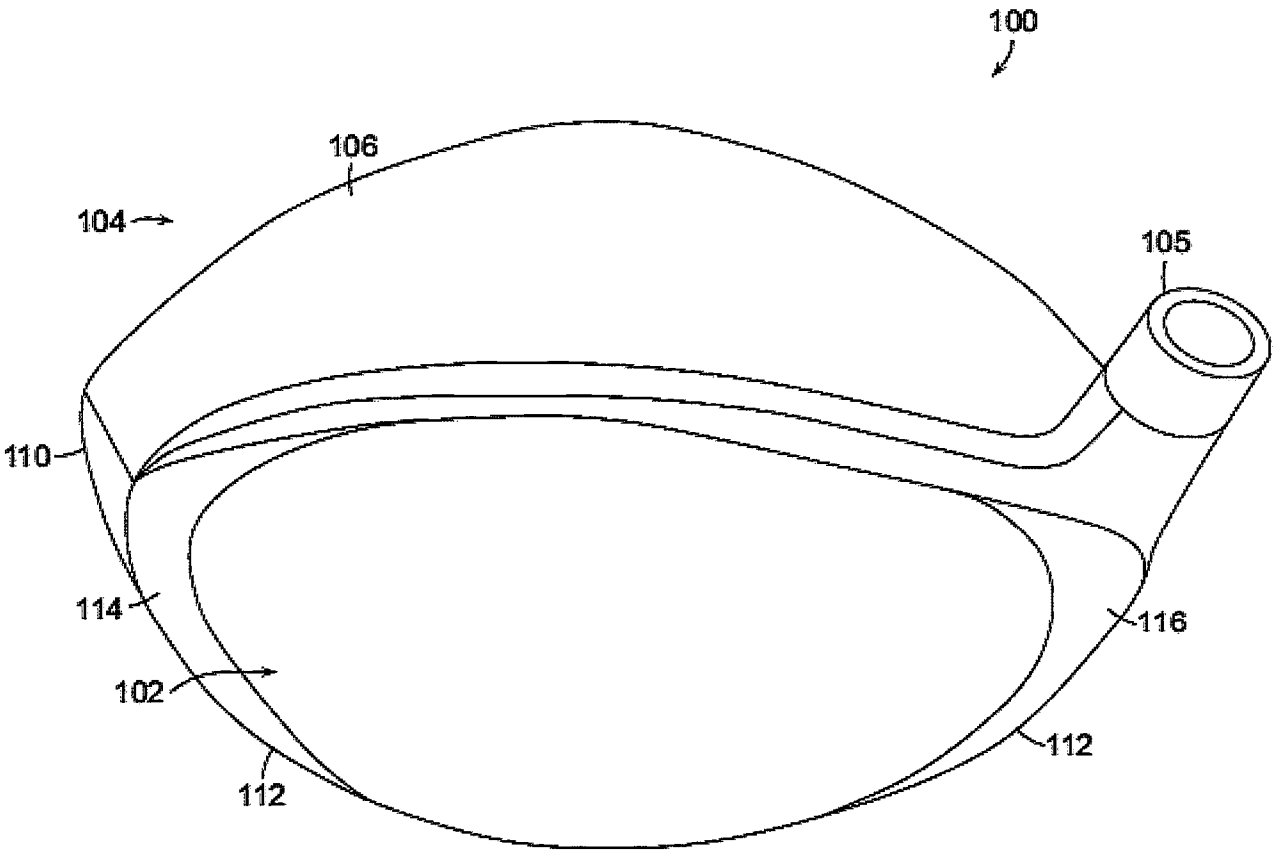
FIG. 1 illustrates a perspective view of one embodiment of a golf club head.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

Embodiments described herein generally relate to golf clubs having an improved sweet spot. More specifically, some embodiments relate to golf club head constructions which concentrate the sweet spot about the geometric center of the golf club head.

FIG. 1 shows an elevated view of a golf club head 100 in accordance with an exemplary embodiment of the present invention. Golf club head 100 shown here in FIG. 1 may generally have a striking face 102, a posterior body portion 104 and a hosel 105. The posterior body portion 104 may generally be further comprised of a crown portion 106, a sole portion (not shown), and a skirt portion 110. The crown portion 106 may generally be connected to the upper portion of the striking face 102 while the sole portion (not shown) may generally be connected to the bottom portion of the striking face 102. The skirt portion 110, as shown in the current exemplary embodiment, may generally be juxtaposed between the crown portion 106 and the sole portion (not shown) to complete the posterior body portion 104.

Golf club head 100, as shown in the current exemplary embodiment depicted by FIG. 1, may generally have a radiused transition portion 112 at least partially surrounding the perimeter of the striking face 102. More specifically, as we can see in FIG. 1, the radiused transition portion 112 may be further comprised of a toe radiused transition portion 114 and a heel radiused transition portion 116 surrounding the striking face 102 near the toe and heel portion of the striking face 102 respectively. It should be noted that although the current exemplary embodiment shown in FIG. 1 only shows the radiused transition portion 112 covering the toe and heel portion of the golf club head 100, the radiused transition portion 112 could completely surround the perimeter of the striking face 102 without departing from the scope and content of the present invention.

It should be noted in FIG. 1 that the striking face 102 may generally have a surface area of greater than about 3600 $mm^2$, more preferably greater than about 3700 $mm^2$, and most preferably greater than about 3750 $mm^2$. Additionally, the radiused transition portion 112 may generally have a surface area of less than about 850 $mm^2$, more preferably less than about 825 $mm^2$, and most preferably less than about 810 $mm^2$. Finally, the entire golf club head 100 may generally have a surface area of between about 32,000 $mm^2$ and about 35,000 $mm^2$. With the surface area value above, it is important to determine the ratio of the surface area of the striking face 102 relative to the total area of the entire golf club head 100. This striking face surface area ratio may generally be greater than about 9%, more preferably greater than about 10%, and most preferably greater than about 11%. Alternatively, the above surface areas may also yield a radiused transition portion surface area ratio. This radiused transition portion surface area ratio may generally be less than about 3.0%, more preferably less than about 2.75%, and most preferably less than about 2.5%.

Figure 2:
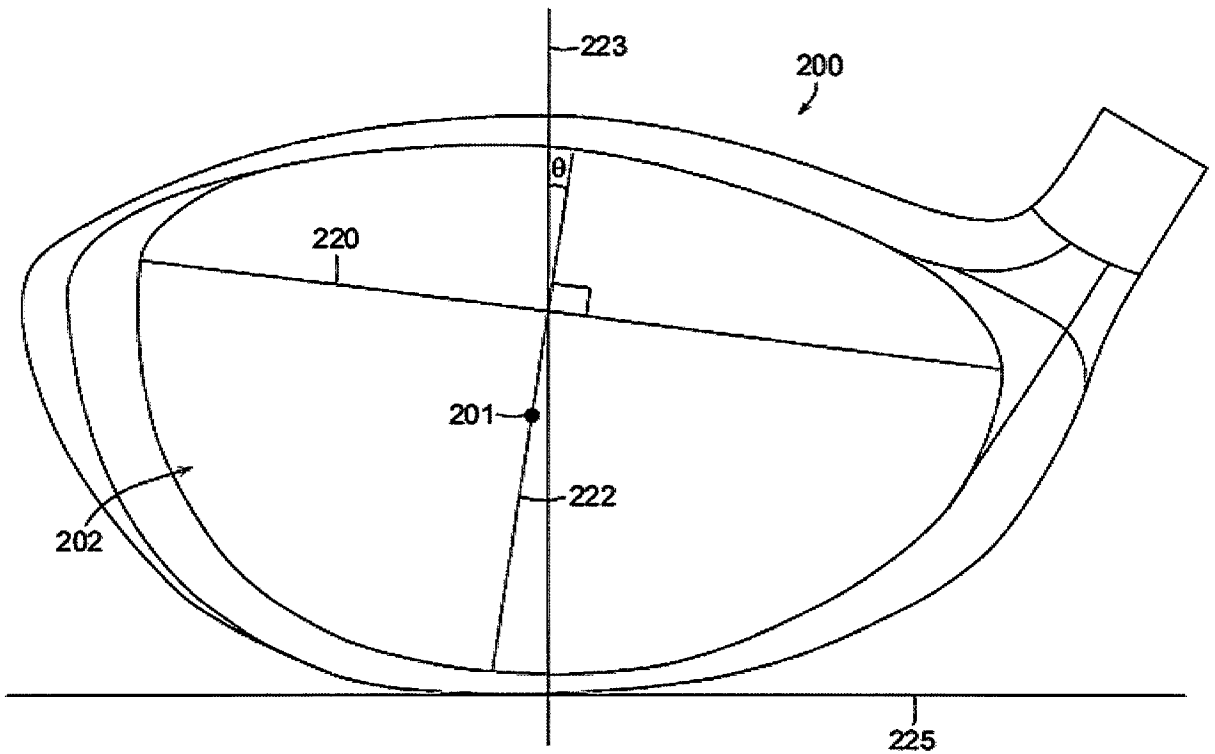
FIG. 2 illustrates a frontal view of a golf club head.

FIG. 2 shows a frontal view of a golf club head 200 in accordance with an exemplary embodiment of the present invention. This frontal view of the golf club head 200 allows a more direct view of the striking face 202 showing the striking face 202 being of a significantly elliptical shape; with a major axis 220 running in a significantly heel to toe direction and a minor axis 222 running in a significantly crown to sole direction. The striking face 202 of the golf club head 200 in accordance with an exemplary embodiment of the present invention may generally have an elliptical factor greater than about 0.33, more preferably greater than about 0.41, and most preferably greater than about 0.50. The elliptical factor discussed above may defined by Equation 1 below:

$$\text{Elliptical Factor} = \frac{\text{Length of Minor Axis 222}}{\text{Length of Major Axis 220}} \quad \text{Eq. (1)}$$

The length of the major axis 220 may generally be defined as the distance of the longest line that can be drawn on the striking face 202. Here, in this current exemplary embodiment shown in FIG. 2, the major axis 220 spans in a direction that is significantly heel to toe; however the major axis 220 could be orientated in any other direction that deviates from the current orientation so long it represents the longest line that can be drawn on the striking face 202 all without departing from the scope and content of the present invention. Minor axis 222, as shown in the current exemplary embodiment, may generally be defined as a line across the striking face 202 that runs perpendicular to the major axis 220, while passing through the geometric center 201 of the striking face 202. In some embodiments, the geometric center 201 of the striking face 202 is located at the midpoint of the minor axis 222. In other embodiments, the geometric center 201 of the striking face 202 is defined by the center of the impact spot determined by the Impact Location Template outlined in the Procedure for Measuring the Flexibility of a Golf Clubhead, USGA-TPX3004, Revision 1.0.0, May 1, 2008 by the United States Golf Association.

The length of the major axis 220, as shown in the current exemplary embodiment, may generally be less than about 120 mm (millimeters), more preferably less than about 110 mm, and most preferably less than about 100 mm. The length of the minor axis 222 on the other hand, as shown in the current exemplary embodiment, may generally be greater than about 40 mm, more preferably greater than about 45 mm, and most preferably greater than about 50 mm. Hence, it can be seen that when the length of the minor axis 222 is divided by the length of the major axis 220, the resulting elliptical factor may generally be within the range discussed above.

The frontal view of golf club head 200 shown in FIG. 2 may also help illustrate how the striking face 202 of the golf club head 200 is tilted in a more upright position while keeping the golf club head 200 in a relatively flat position. Alternatively speaking, the vertical minor axis 222 of the striking face 202 may generally be tilted at an angle θ when compared to a vertical line 223 that is vertical to the ground 225. The angle θ, as shown in the current exemplary embodiment, may generally be greater than about 3.0 degrees and less than about 16.0 degrees, more preferably greater than about 3.0 degrees and less than about 12.0 degrees, and most preferably greater than about 3.0 degrees and less than about 8.0 degrees. As it can be seen from FIG. 2, the tilting of the striking face 202 of the golf club head 200 relative to the ground 225 will also cause the major axis 220 and minor axis 222 to tilt to the same extent and in the same direction. Viewed in another way, the tilt of the striking face 202 may also be defined as having the major axis 220 and the minor axis 222 both tilted in a direction of high toe to low heel by an angle of greater than about 3.0 degrees and less than about 16.0 degrees, more preferably greater than about 3.0 degrees and less than about 12.0 degrees, and most preferably greater than about 3.0 degrees and less than about 8.0 degrees.

Figure 3:
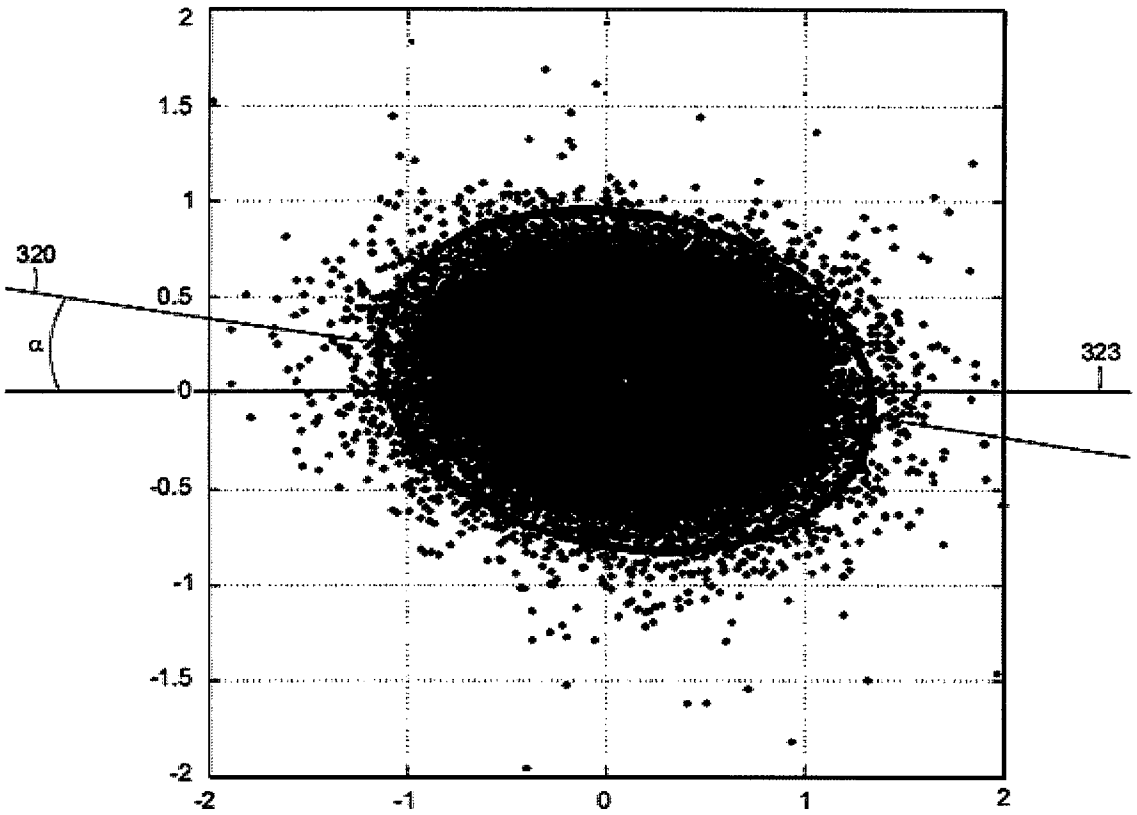
FIG. 3 is a graphical representation of a typical impact pattern between a golf club and a golf ball.

To understand the rationale behind the tilting of the striking face 202 of the golf club head 200, it may be beneficial to view FIG. 3 showing the typical impact pattern of a golfer relative to the striking face 202; with each of the dots on the graph representing a typical hit location when a golfer hits a golf ball with a golf club. As it has been reported in F. Werner and R. Greig, How Golf Clubs Really Work and How to Optimize Their Designs, Ch. 4, pp. 17-21 (2000), a typical distribution of golf ball hits on the face of a driver clubs follows an elliptical pattern with its major axis orientating in a direction from high toe to low heel, corresponding with the elliptical pattern shown in FIG. 3. Examining more closely the impact pattern shown in FIG. 3, we can determine that the major axis 320 of the impact pattern may form an angle α with the horizontal axis 323. This angle α may generally coincide with the tilt angle θ of the striking face 202 of the golf club head 200 shown in FIG. 2. More specifically, α may generally be greater than about 3.0 degrees and less than about 16.0 degrees, more preferably greater than about 3.0 degrees and less than about 12.0 degrees, and most preferably greater than about 3.0 degrees and less than about 8.0 degrees.

Returning to FIG. 2, we can see from the hit pattern shown in FIG. 3 that it may be desirable to tilt the striking face 202 of the golf club head 200 at an angle θ that corresponds to the tile angle α of the impact pattern. More important than the tilting of the striking face 202 of the golf club head 200 results in the tilting of the major axis 220 and the minor axis 222, as tilting the afore mentioned axes will allow the striking face 202 to be more in alignment with the typical hit pattern shown in FIG. 3.

Figure 4:
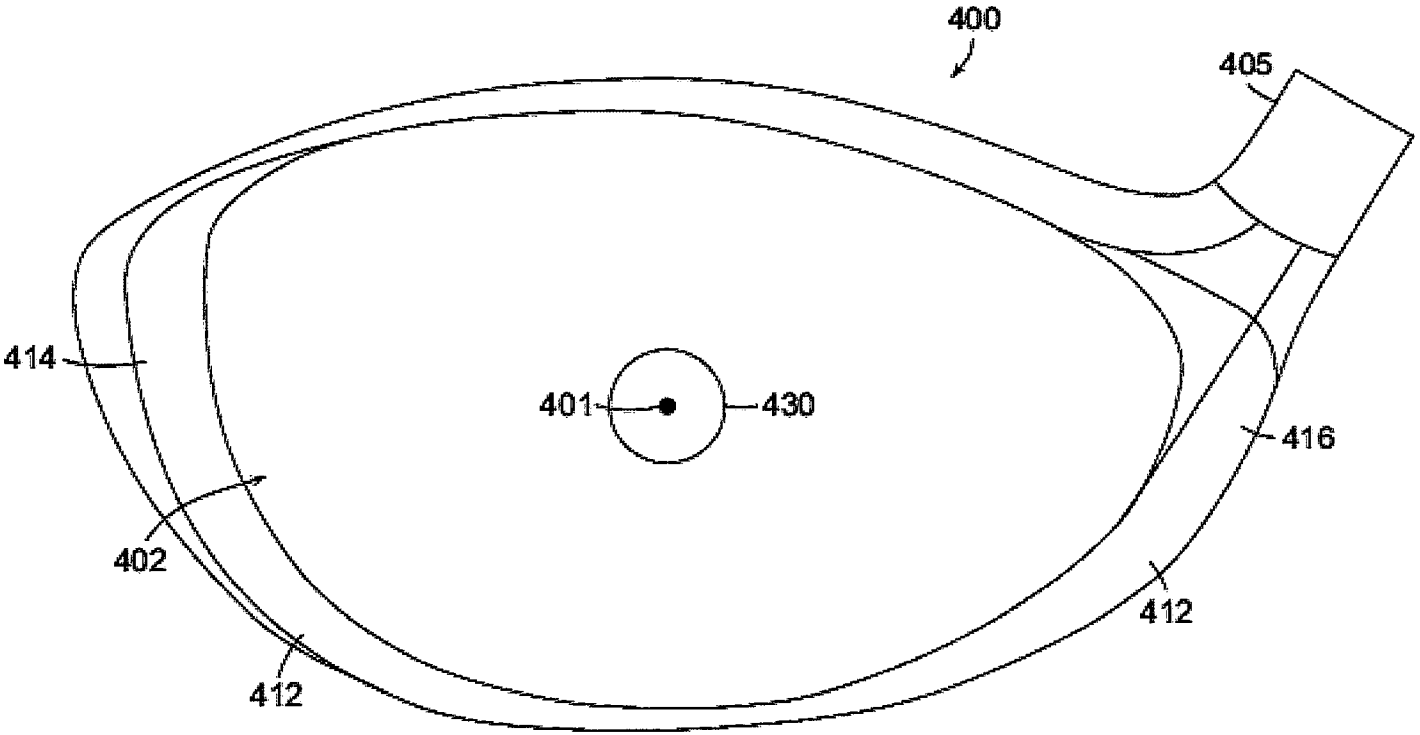
FIG. 4 illustrates a frontal view of a golf club head having a sweet spot located near the geometric center of the striking face.

Turning now to FIG. 4, showing another frontal view of a golf club head, we can see that the golf club head 400 is shown with a sweet spot 430 located near the geometric center 401 of the striking face 402 of the golf club head 400. More specifically, the sweet spot 430 may generally be concentric with the geometric center 401 of the striking face 402 of the golf club head 400. The sweet spot 430, within the context of the current application, may generally be defined as the area of the entire striking face 402 that is capable of achieving at least 99.7% of the maximum ballspeed achievable by the golf club head 400. The 99.7% value utilized in determining the size of the sweet spot 430 may be relevant, because a golf ball that is capable of achieving 99.7% of the maximum ballspeed only loses about ½ a mile per hour of ballspeed when compared to a direct central hit achieving 100% of the maximum ballspeed capable by the golf club head 400. The maximum ballspeed achievable by the golf club head 400, as shown in the current exemplary embodiment, may generally relate to the highest ballspeed that can be achieved by the golf club head regardless of where the golf club head 400 strikes a golf ball.

Figure 5:
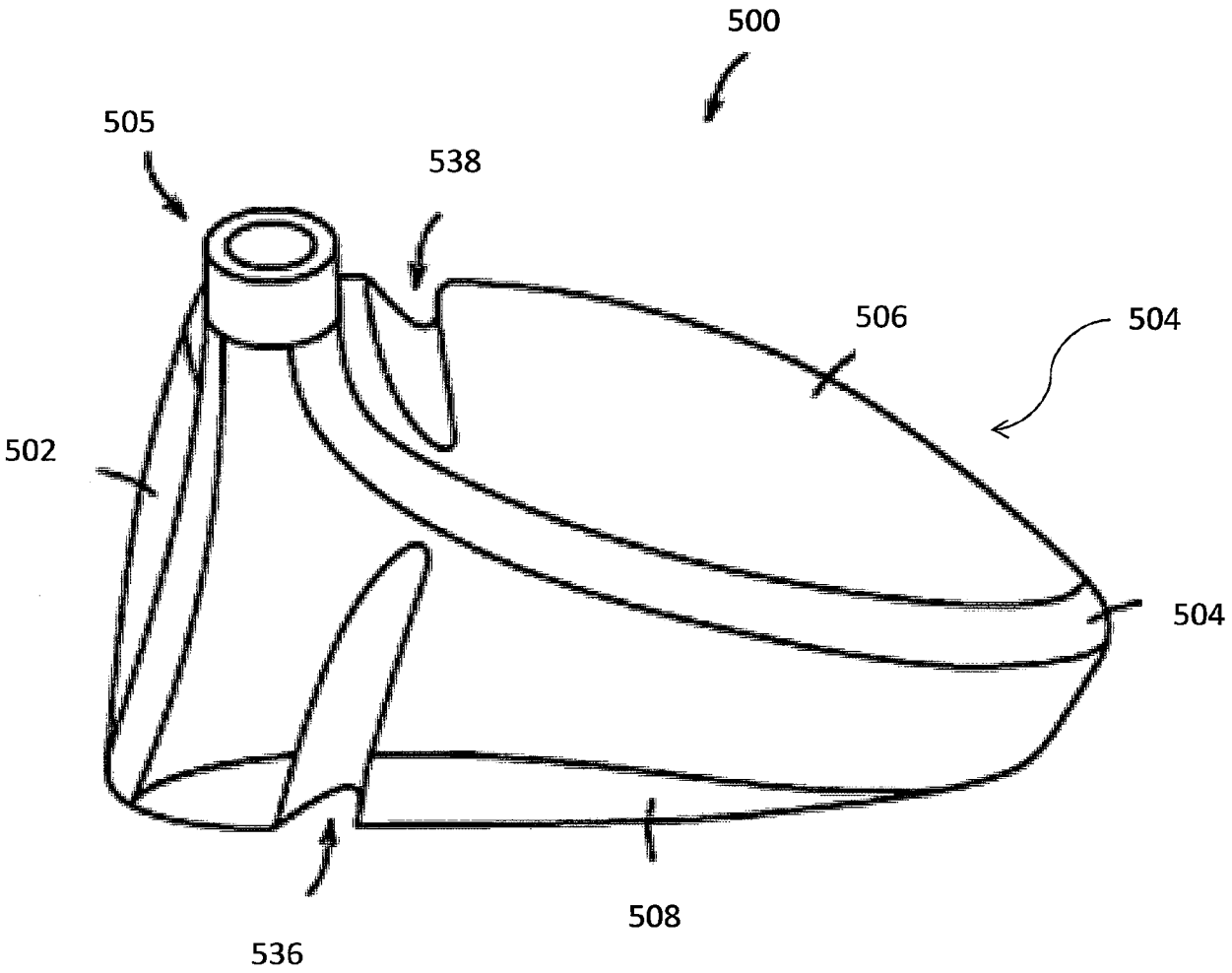
FIG. 5 illustrates a side view of one embodiment of a golf club heading includes flexures.

In some embodiments, a golf club head can include various features which may affect the location of the sweet spot relative to the geometric center of the striking face of the golf club head. Examples of such features may be found in commonly owned U.S. patent application Ser. No. 14/089,574 to Golden et al., Golf Club with Flexure, filed on Nov. 25, 2013, the disclosure of which is hereby incorporated by reference in its entirety. Flexures 536, 538, as illustrated in FIG. 5 are examples of features which can shift the sweet spot away from the geometric center of the striking face. Flexures 536, 538 are generally formed in a forward portion of the crown, sole, and/or skirt. Flexure 536, is an elongate corrugation that extends in a generally heel to toe direction and that is formed in a forward portion of the sole. Flexure 538 is formed in a forward portion of the crown. Flexures 536, 538 are generally flexible in a fore/aft direction and provide a flexible portion of the club head 500 away from the striking face 502 so that they allow a portion of the striking face 502 to translate and rotate as a unit, in addition to flexing locally near the point of impact, when the striking face impacts a golf ball. Flexures 536, 538 can provide improved performance for center face impacts with a golf ball as well as off-center impacts between the striking face 502 and a golf ball.

Figure 6:
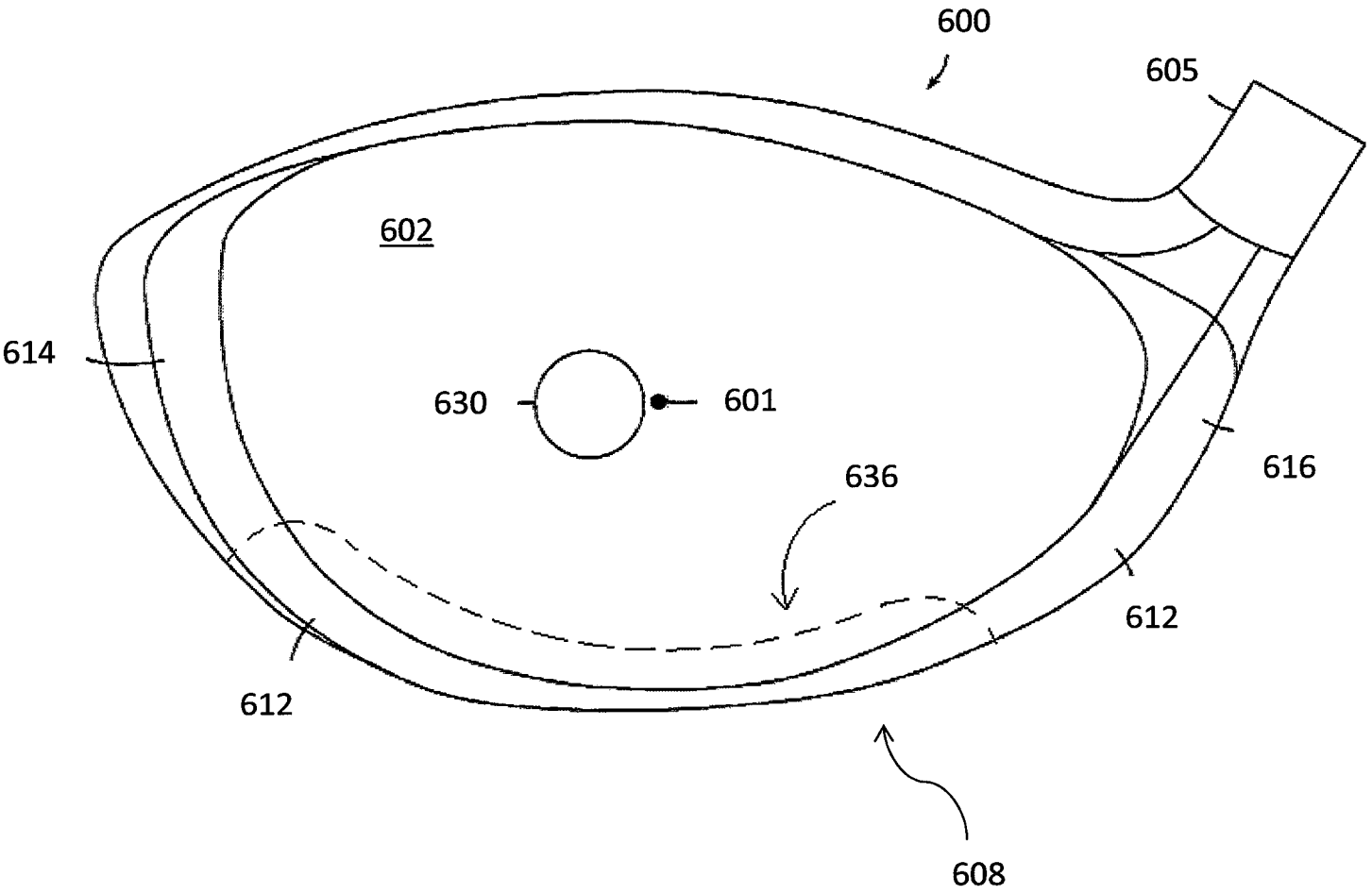
FIG. 6 illustrates a frontal view of a golf club head including a flexure and a sweet spot offset from the geometric center of the striking face.

FIG. 6 illustrates a flexure 636, formed in a forward portion of the sole portion 608. Flexure 636 generally extends further toeward from the geometric center 601 of the striking face 602 than it extends heelward. Golf club head features, such as the toe biased flexure 636, can asymmetrically affect the stiffness of the golf club head 600 and thus effect the location of the sweet spot 630 on the striking face. FIG. 6 illustrates how flexure 636 has shifted the sweet spot 636 toeward from the geometric center 601 of the striking face 602. Other constructions, features, or asymmetries in golf club head design may also shift a sweet spot 630 from the geometric center 601 of the golf club head 600.

Figure 7:
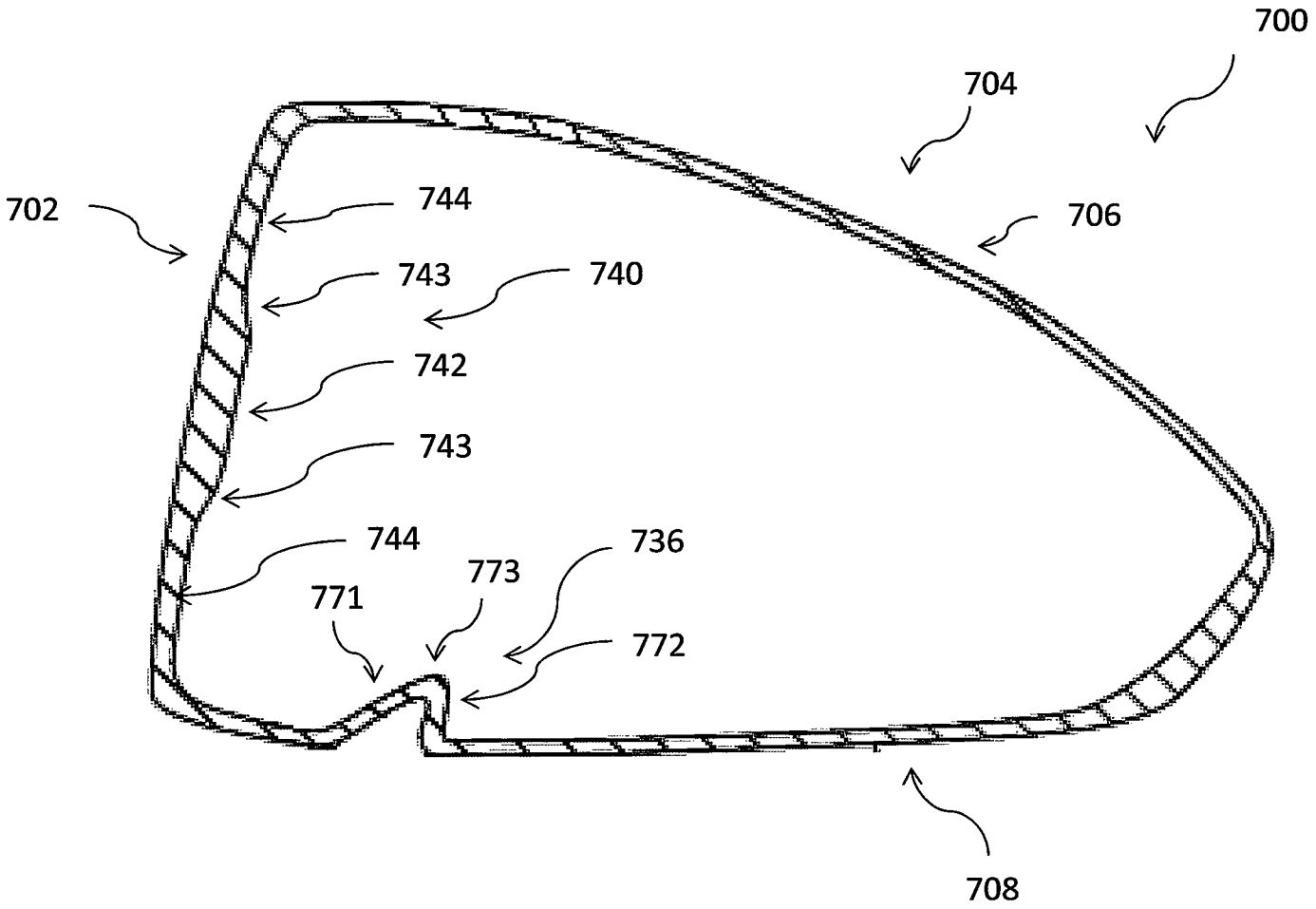
FIG. 7 illustrates a side view of one embodiment of a golf club head including a striking face with a variable thickness profile and a flexure.

As discussed above, it is preferable to locate the sweet spot at the geometric center of the striking face, as illustrated in FIG. 4. FIG. 7 illustrates a golf club head 700 in accordance with an exemplary embodiment of the present invention having a striking face 702 with a variable face thickness profile 740. Golf club head 700, as illustrated in FIG. 7, may have a striking face 702 with a variable face thickness profile 740 behind the striking face 702. More specifically, the variable face thickness profile 740, as shown in the current exemplary embodiment, may generally be comprised of a thick central portion 742 surrounded by a transition portion 743, which is then surrounded by a thin perimeter portion 744. Because the striking face 702 of a golf club head 700 deforms like a trampoline when striking a golf ball, having a variable face thickness profile 740 allows the thin perimeter portion 744 of the striking face 702 to be thin enough to provide a trampoline effect while the thick central portion 742 of the variable face thickness profile 740 provides sufficient thickness to endure the stresses associated with a golf ball impact. Because the radiused transition portion 112 (shown in FIG. 1) may provide additional structural stiffness to the striking face 702 of the golf club head 700, the striking face 702 of the golf club head may be made thinner to create an even bigger sweet spot. More specifically, the increased structural stiffness may allow the thickness of the thin perimeter portion 744 to be less than about 3.0 mm thick, more preferably less than about 2.9 mm thick, and most preferably less than about 2.8 mm thick. More detailed disclosure regarding using variable face thickness to improve the performance of a golf club head may be found in U.S. Pat. No. 7,029,403 to Rice et. al., the disclosure of which is hereby incorporated by reference in its entirety.

FIG. 7 also illustrates a flexure 736. The flexure 736 is spaced from the striking face 702. The flexure 736 includes a front wall 771, a rear wall 772, and an apex 773. The front wall 771 and rear wall 772 both extend into an interior of the golf club head 700. The front wall 771 and rear wall 772 are coupled at the apex 773.

Figure 8:
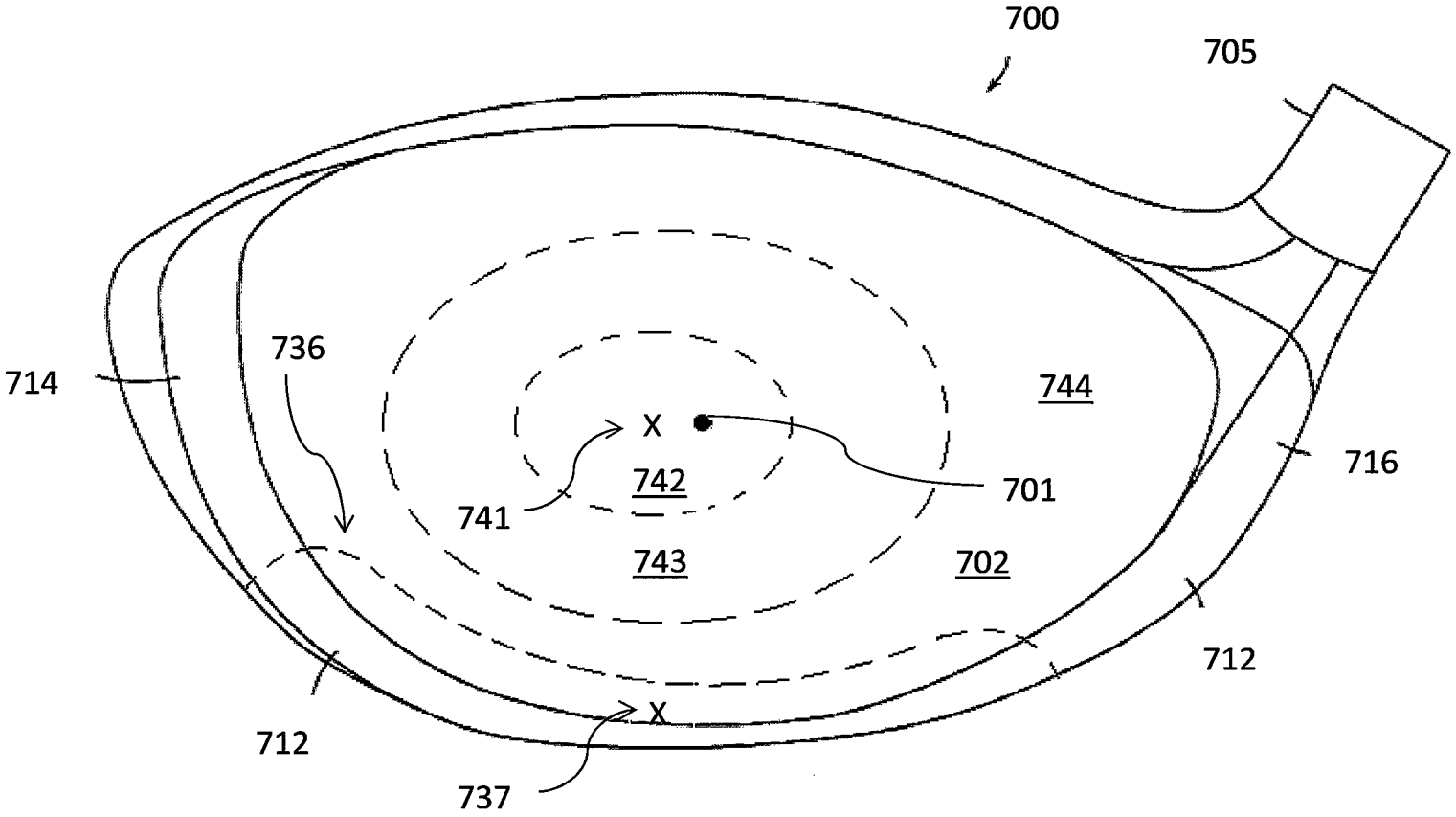
FIG. 8 illustrates a frontal view of the internal geometry of the golf club head of FIG. 7.

FIG. 8 shows a frontal view of the internal geometry of the golf club head 700 of FIG. 7 with a variable face thickness profile 740. FIG. 8 shows the relative size and position of the thick central portion 742, the transition portion 743, and the thin perimeter portion 744. More specifically, FIG. 8 shows the thick central portion 742 offset from the geometric center 701 of the striking face 702. As discussed above and illustrated in FIG. 6, various golf club head constructions or features, such as flexure 636, can create a sweet spot 630 which is not centered on the geometric center 601 of the striking face. As illustrated in FIG. 8, a striking face 702 incorporating a variable face thickness profile 740 with a thick central portion 742 offset towards the toe of the golf club head 700 can provide a sweet spot focused about the geometric center 701 of the striking face 702. In other embodiments, the thick central portion 742 may be offset towards the heel of the golf club head 700. In some embodiments, the thick central portion 742 is offset in the same direction as a flexure 736, as illustrated in FIG. 8. Locating the thick central portion 742 in a position offset from the geometric center 701 of the striking face 702, can shift the sweet spot from a less than ideal position as illustrated in FIG. 6, to a more ideal position focused about the geometric center 701 of the striking face 702, as illustrated in FIG. 4, even when the golf club head 700 includes features which would otherwise shift the sweet spot from the geometric center 701, such as a flexure 736, as illustrated in FIGS. 7 and 8.

Figure 9:
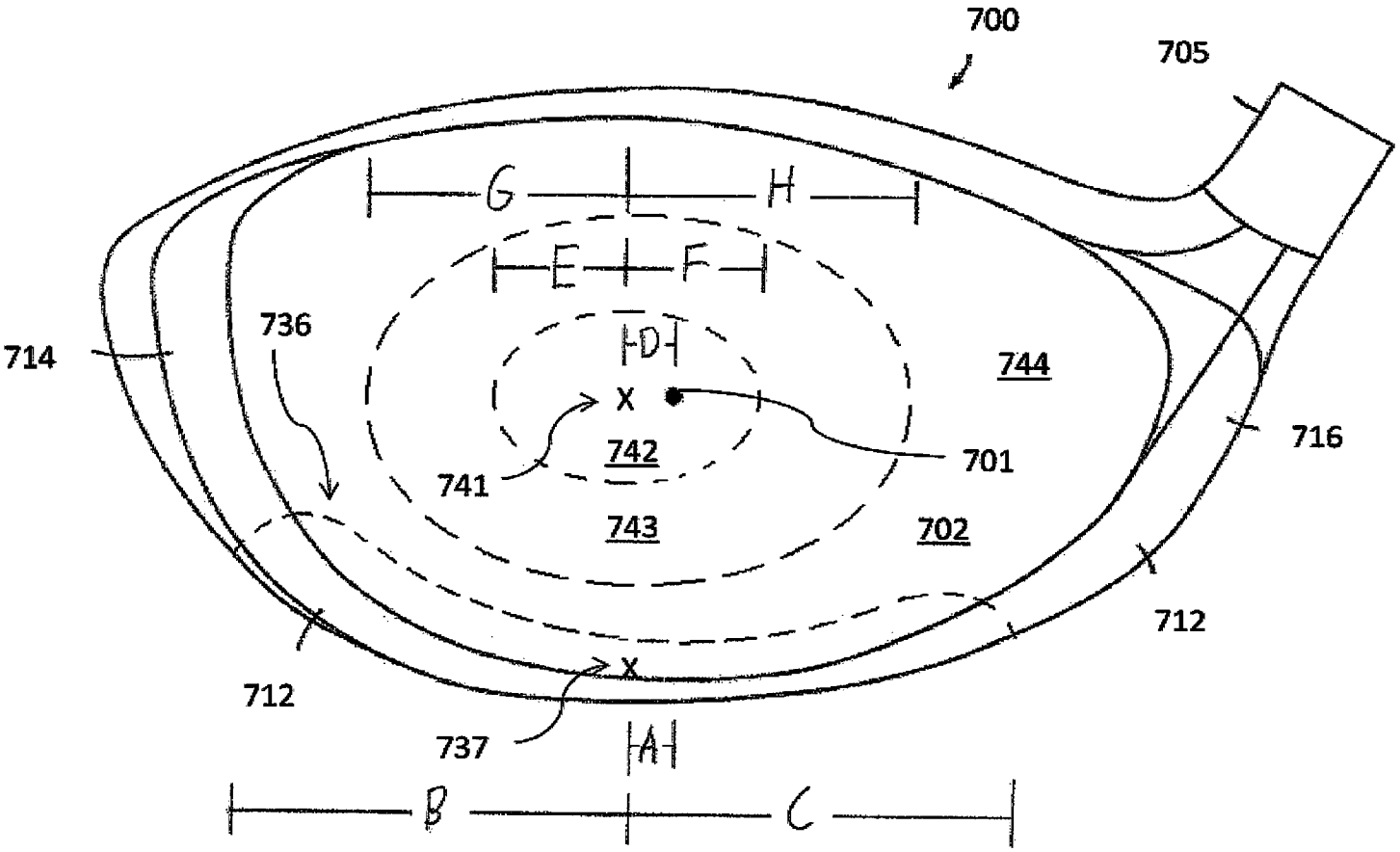
FIG. 9 illustrates a frontal view of the internal geometry of the golf club head of FIG. 7, including a plurality of relationships regarding the location of portions of the variable face thickness profile and flexure relative to the geometric center of the striking face, FIG. 10 of the accompanying drawings shows a cross-sectional view of a golf club head in accordance with an alternative embodiment of the present invention, FIG. 11 of the accompanying drawings shows an enlarged cross-sectional view of a portion of a sole of a golf club head of region A shown in FIG. 10, FIG. 12 of the accompanying drawings shows a cross-sectional view of a golf club head in accordance with a further alternative embodiment of the present invention, FIG. 13 of the accompanying drawings shows an enlarged cross-sectional view of a portion of a sole of a golf club head of region B shown in FIG. 12, and FIG. 14 of the accompanying drawings shows a cross-sectional view along a different plane showing the sole features of a golf club head in accordance with the further alternative embodiment of the present invention.

FIG. 9 replicates the frontal view of the internal geometry of the golf club head 700 from FIG. 8, including a plurality of relationships regarding the location of portions of the variable face thickness profile 740 and flexure 736 relative to the geometric center 701 of the striking face 702 to further illustrate various embodiments of the present invention. As discussed above and illustrated in FIG. 6, various golf club head constructions or features, such as flexure 636, can alter the flex characteristics of the striking face 602 and create a sweet spot 630 which is not centered on the geometric center 601 of the striking face. FIG. 9 shows that in one embodiment, the flexure 736, or other golf club head feature, can extend further towards the toe of the golf club head 700 than the heel of the golf club head 700.

As illustrated in FIG. 9, the center 737 of the flexure 736, signified by an X, is offset a Distance A from the geometric center 701 towards the toe of the golf club head. Distance A, along with Distances B-H discussed below, are measured along an axis parallel to the major axis 220 as illustrated in FIG. 2 and as discussed above. The center 737 of the flexure 736 is located substantially equidistant from the toe most portion of the flexure 736, and the heel most portion of the flexure 736. Therefore the center 737 of the flexure 736 is defined by Distance B substantially equaling Distance C, wherein Distance B is the distance between the center 737 and the toe most portion of the flexure 736 and Distance C is the distance between the center 737 and the heel most portion of the flexure 736. In some embodiments, as illustrated in FIG. 9, the center 737 of the flexure 736 is offset a Distance A toeward from the geometric center of the club head.

In some embodiments, Distance A can be between 0.25 mm and 15 mm. In some embodiments, Distance A can be between 1 mm and 10 mm. In some embodiments, Distance A can be between 2 mm and 8 mm. In some embodiments, Distance A can be between 3 mm and 7 mm. In some embodiments, Distance A can be between 4 mm and 6 mm. In some embodiments, Distance A can be greater than 1 mm. In some embodiments, Distance A can be greater than 2 mm. In some embodiments, Distance A can be greater than 3 mm. In some embodiments, Distance A can be greater than 4 mm. In some embodiments, Distance A can be greater than 5 mm.

As discussed above in relation to FIGS. 8 and 9, the thick central portion 742 can be offset from the geometric center 701 of the striking face 702. FIG. 9 illustrates the center 741 of the thick central portion 742, signified by an X, offset towards the toe of the golf club head 700 a Distance D from the geometric center 701 of the striking face 702. The center 741 of the thick central portion 742 is located substantially equidistant from the toe most portion of the thick central portion 742 and the heel most portion of the thick central portion 742. Therefore the center 741 of the thick central portion 742 is defined by Distance E substantially equaling Distance F, wherein Distance E is the distance between the center 741 and the toe most portion of the thick central portion 742 and Distance F is the distance between the center 741 and the heel most portion of the thick central portion 742. In some embodiments, as illustrated in FIGS. 8 and 9, the golf club head can comprise a flexure 736 with a center 737 offset towards the toe as well as a thick central portion 742 with a center 741 offset towards the toe. In some embodiments, the center 741 of the thick central portion 742 can be offset a Distance D from the geometric center 701, which is substantially similar to distance A, the distance which the center 737 of the flexure 736 is offset from the geometric center 701.

In some embodiments, Distance D can be between 0.25 mm and 15 mm. In some embodiments, Distance D can be between 1 mm and 10 mm. In some embodiments, Distance D can be between 2 mm and 8 mm. In some embodiments, Distance D can be between 3 mm and 7 mm. In some embodiments, Distance D can be between 4 mm and 6 mm. In some embodiments, Distance D can be greater than 1 mm. In some embodiments, Distance A can be greater than 2 mm. In some embodiments, Distance D can be greater than 3 mm. In some embodiments, Distance D can be greater than 4 mm. In some embodiments, Distance D can be greater than 5 mm.

As discussed above and as illustrated in FIG. 9, in addition to a thick central portion 742, the variable thickness profile 740 also includes a transition portion 743, and a thin perimeter portion 744. In some embodiments, the transition portion 743 is substantially centered on the thick central portion 742, wherein Distance G represents the distance from the toe most portion of the transition portion to the center 741 of the thick central portion 742, H represents the distance from the heel most portion of the transition portion to the center 741 of the thick central portion 742, and wherein Distance G is substantially equal to Distance H. In some embodiments, Distance G and Distance H are each between approximately 15 mm and 30 mm. In some embodiments, Distance G and Distance H are each between approximately 20 mm and 25 mm. In some embodiments, Distance G and Distance H are each between approximately 22 mm and 24 mm. In other embodiments, the transition portion 743 may not be centered about the thick central portion 742 and Distance G may not equal Distance H. In some embodiments, the transition portion 743 can be offset towards the heel from the thick central portion 742 wherein Distance H is greater than Distance G. In some embodiments, Distance H is at least 1 mm larger than Distance G. In some embodiments, Distance H is at least 2 mm larger than Distance G. In other embodiments, Distance G may be greater than Distance H. In some embodiments, Distance G is at least 1 mm larger than Distance H. In some embodiments, Distance G is at least 2 mm larger than Distance H.

In some embodiments, the center 737 of the flexure 736 may not be offset from the geometric center 701 of the striking face 702, but may still provide asymmetric stiffness properties, shifting the sweet spot from the geometric center 701. Asymmetric stiffness properties can be produced by a plurality of constructions which may include, for example, asymmetric proportions, asymmetric thicknesses, asymmetric curvature, hosel structure, asymmetric ribbing, etc. Therefore, in some embodiments, the golf club head 701 can include a flexure 736 with a center 737 which is not offset from the geometric center 701, as well as a thick central portion 742 with a center 741 offset towards the toe from the geometric center 701. In another embodiment, the center 741 of the thick central portion 742 could be offset towards the heel. In some embodiments, the center 741 of the thick central portion 742 could be offset towards the portion of the golf club head which includes the more compliant portion of the flexure 736 or other golf club head feature.

One method of measuring the performance of a striking face is Characteristic Time (CT). Measurement of CT is outlined in the Procedure for Measuring the Flexibility of a Golf Clubhead, USGA-TPX3004, Revision 1.0.0, May 1, 2008 by the United States Golf Association. CT can be measured at various locations on the striking face 702 of the golf club head 700. CT can be measured at the geometric center 701 of the striking face 702 ($CT_{Center}$). CT can be measured at a location offset from the geometric center 701 of the striking face 702, such as a point offset 0.5" towards the toe from the geometric center 702 along an axis parallel to the major axis ($CT_{Toe\text{-}0.5''}$), or a point offset 0.5" towards the heel from the geometric center 702 along an axis parallel to the major axis ($CT_{Heel\text{-}0.5''}$). In some embodiments, the golf club head 700 can have a CT relationship wherein $|(CT_{Toe\text{-}0.5''}/CT_{Center})-1|\leq 0.06$. In some embodiments, the golf club head 700 can have a CT relationship wherein $|(CT_{Heel\text{-}0.5''}/CT_{Center})-1|\leq 0.06$.

For example, one embodiment of a club head could have a $CT_{Center}$ value of 235, a $CT_{Toe\text{-}0.5''}$ value of 247, and a $CT_{Heel\text{-}0.5''}$ value of 234. The absolute value of $(CT_{Toe\text{-}0.5''}/CT_{Center})-1$ equals 0.051064 which satisfies $|(CT_{Toe\text{-}0.5''}/CT_{Center})-1|\leq 0.06$. Also, the absolute value of $(CT_{Heel\text{-}0.5''}/CT_{Center})-1$ equals 0.012766 which satisfies $|(CT_{Heel\text{-}0.5''}/CT_{Center})-1|\leq 0.06$. In another embodiment, the golf club head 700 can have a CT relationship wherein $|(CT_{Toe\text{-}0.5''}/CT_{Center})-1|\leq 0.05$. In another embodiment, the golf club head 700 can have a CT relationship wherein $|(CT_{Heel\text{-}0.5''}/CT_{Center})-1|\leq 0.05$. In another embodiment, the golf club head 700 can have a CT relationship wherein $|(CT_{Toe\text{-}0.5''}/CT_{Center})-1|\leq 0.04$. In another embodiment, the golf club head 700 can have a CT relationship wherein $|(CT_{Heel\text{-}0.5''}/CT_{Center})-1|\leq 0.04$. In another embodiment, the golf club head 700 can have a CT relationship wherein $|(CT_{Toe\text{-}0.5''}/CT_{Center})-1|\leq 0.03$. In another embodiment, the golf club head 700 can have a CT relationship wherein $|(CT_{Heel\text{-}0.5''}/CT_{Center})-1|\leq 0.03$.

Figure 10:
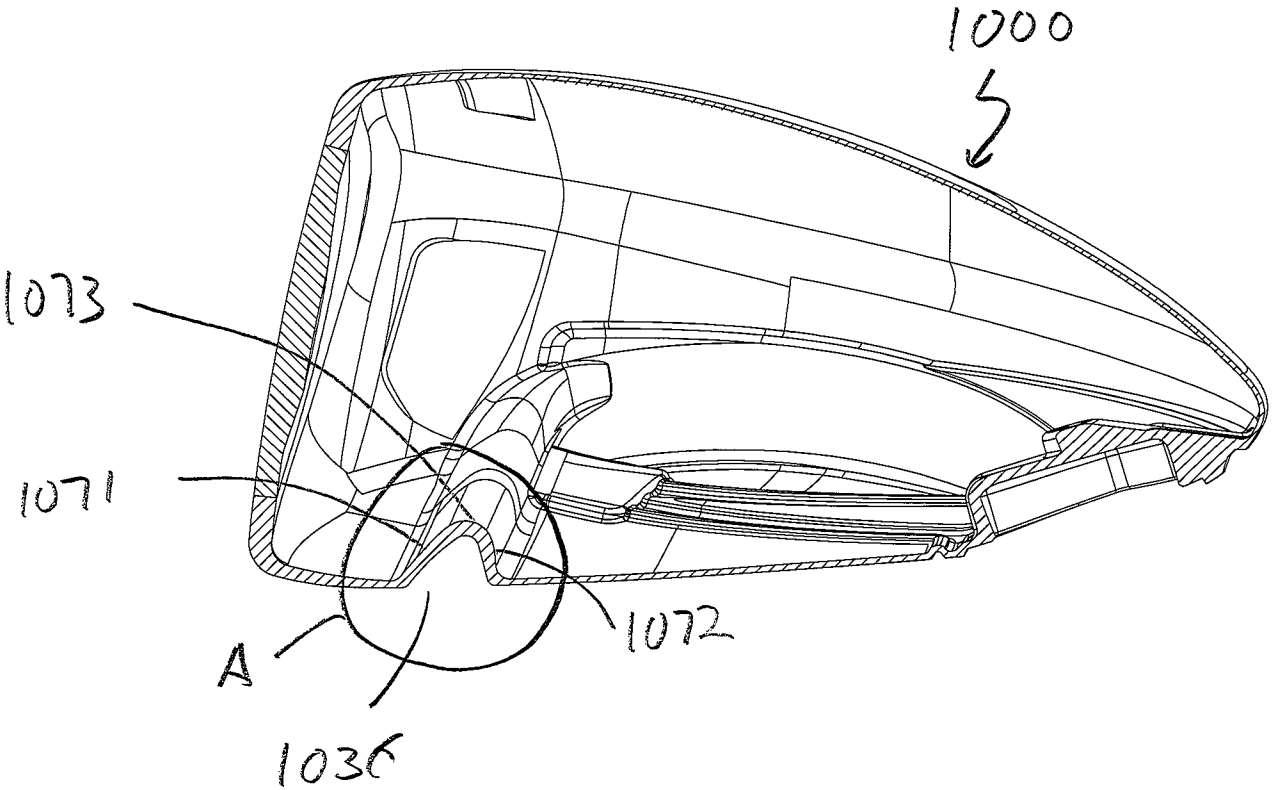

FIG. 10 of the accompanying drawings shows a cross-sectional view of a golf club head 1000 in accordance with an alternative embodiment of the present invention. More specifically, the present invention incorporates an improved flexure 1036 section that improves the performance by having different thicknesses at different portions of the flexure 1036 to adjust for the different stresses generated by the golf club head 1000 during impact with a golf ball. The flexure 1036 of present embodiment may generally have a thickened front wall 1071, a thickened back wall 1072, with an apex 1073 having the highest thickness. Due to the fact that the stress level may occur at different locations within the flexure 1036 itself, different portions of the flexure 1036 may have their own unique thicknesses without departing from the scope and content of the present invention. More specifically, it can be said that the front wall 1071 may have a first thickness d1, the apex 1073 may have a second thickness d2, and the rear wall 1072 may have a third thickness d3.

Figure 11:
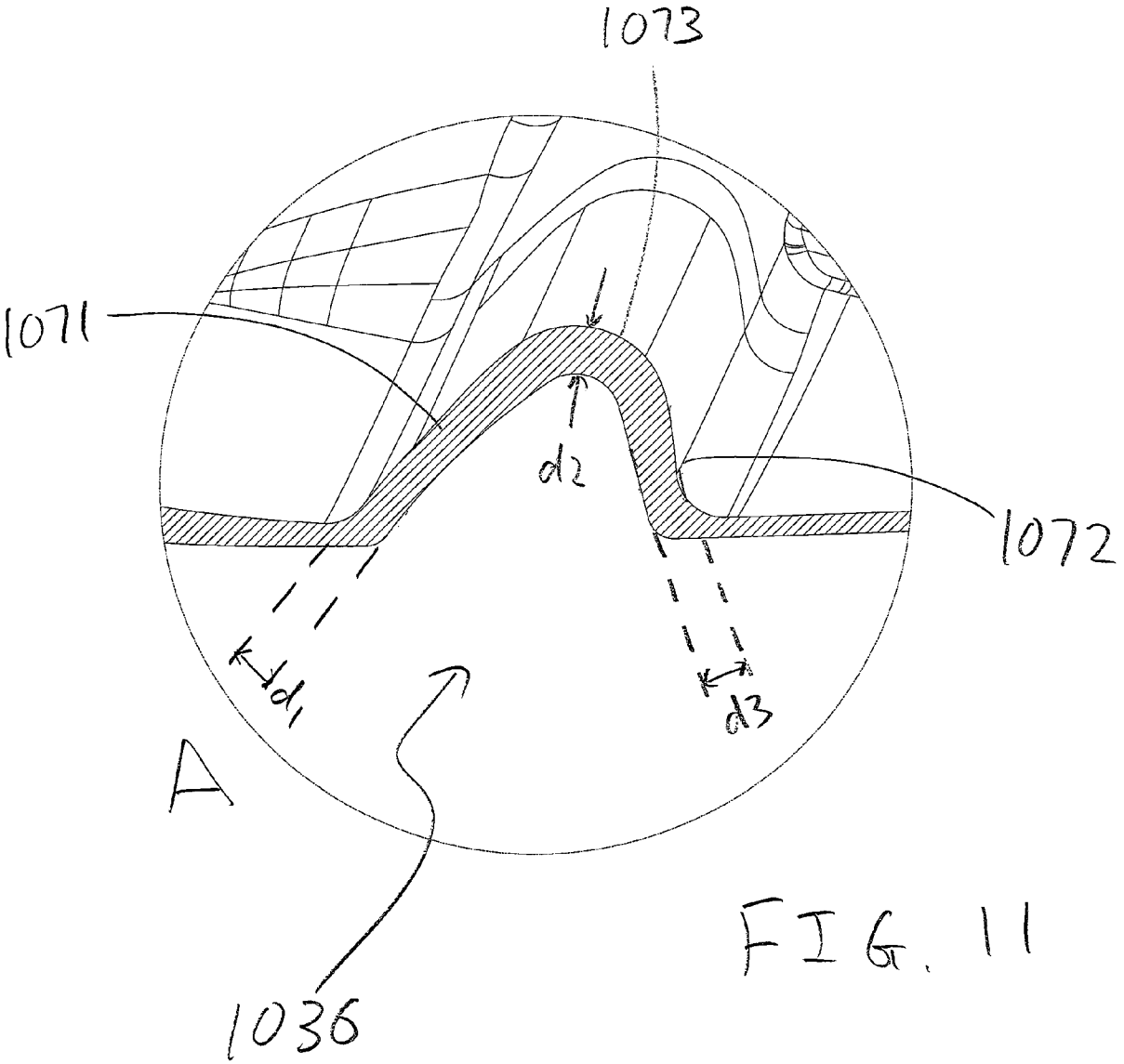

FIG. 11 shows an enlarged view of the circular region A shown in FIG. 10, allowing the front wall 1072, rear wall 1072, and apex 1073 of the flexure 1036 to be shown more clearly with their respective dimensions. More specifically, it can be said that the portion of the sole leading up to the front wall 1071 may generally have a thickness of about 0.80 mm leading into a front wall 1071 thickness d1 of greater than about 1.10 mm, more preferably greater than about 1.20 mm, and most preferably greater than about 1.30 mm. This thickened front wall 1071 may generally help improve the durability of the flexure 1036, as the front wall 1071 portion of the flexure 1036 generally experiences increased stress levels. Transitioning after the front wall 1071, the flexure 1036 then enters the apex 1073. The apex 1073, as shown in this exemplary embodiment of the present invention, may generally have the greatest wall thickness d2 out of the entirety of the flexure 1036. In the current embodiment of the present invention, the thickness d2 of the apex 1073 may generally be greater than about 1.50 mm, more preferably greater than about 1.60 mm, and most preferably greater than about 1.75 mm. Finally, the flexure 1036 may have a back wall 1072 having a thickness d3 greater than about 1.10 mm, more preferably greater than about 1.20 mm, and most preferably greater than about 1.30 mm as the flexure 1036 transitions towards the sole portion of the golf club head 1000.

Based on the above, it can be said that the flexure 1036 may have a front wall 1071 thickness equal to the rear wall 1072 thickness, while the maximum thickness of the flexure 1036 may generally occur at the apex 1073. The maximum thickness is generally greater than about 120% of the thickness of the front wall 1071 and the rear wall 1072, more preferably greater than about 125% of the thickness of the front wall 1071 and the rear wall 1072, and most preferably greater than about 130% of the thickness of the front wall 1071 and the rear wall 1072.

Figure 12:
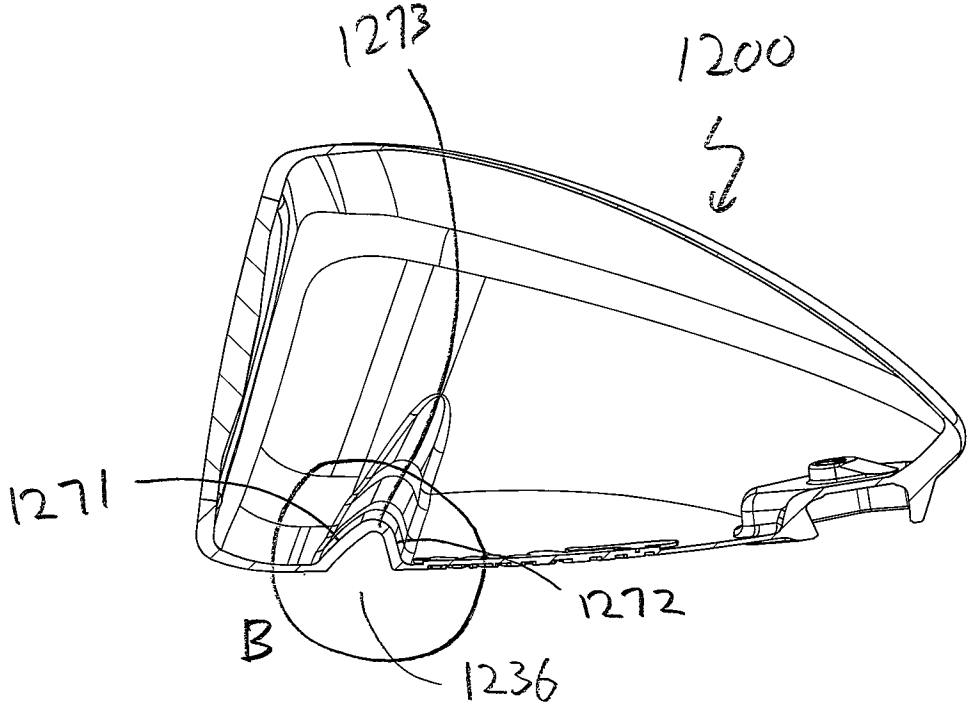

FIG. 12 of the accompanying drawings shows a cross-sectional view of a golf club head 1200 in accordance with a further alternative embodiment of the present invention wherein the thickness of the flexure 1236 is different between the front wall 1271 and the rear wall 1272. In fact, in this embodiment of the present invention, the thickest portion may be shifted away from the apex 1273 towards the front wall 1271, and the apex 1273 may serve as a transition region instead of the point of maximum wall thickness. Moreover, this embodiment of the present invention may also incorporate a thickness variation within the flexure 1236 in a heel and toe orientation without departing from the scope and content of the present invention.

Figure 13:
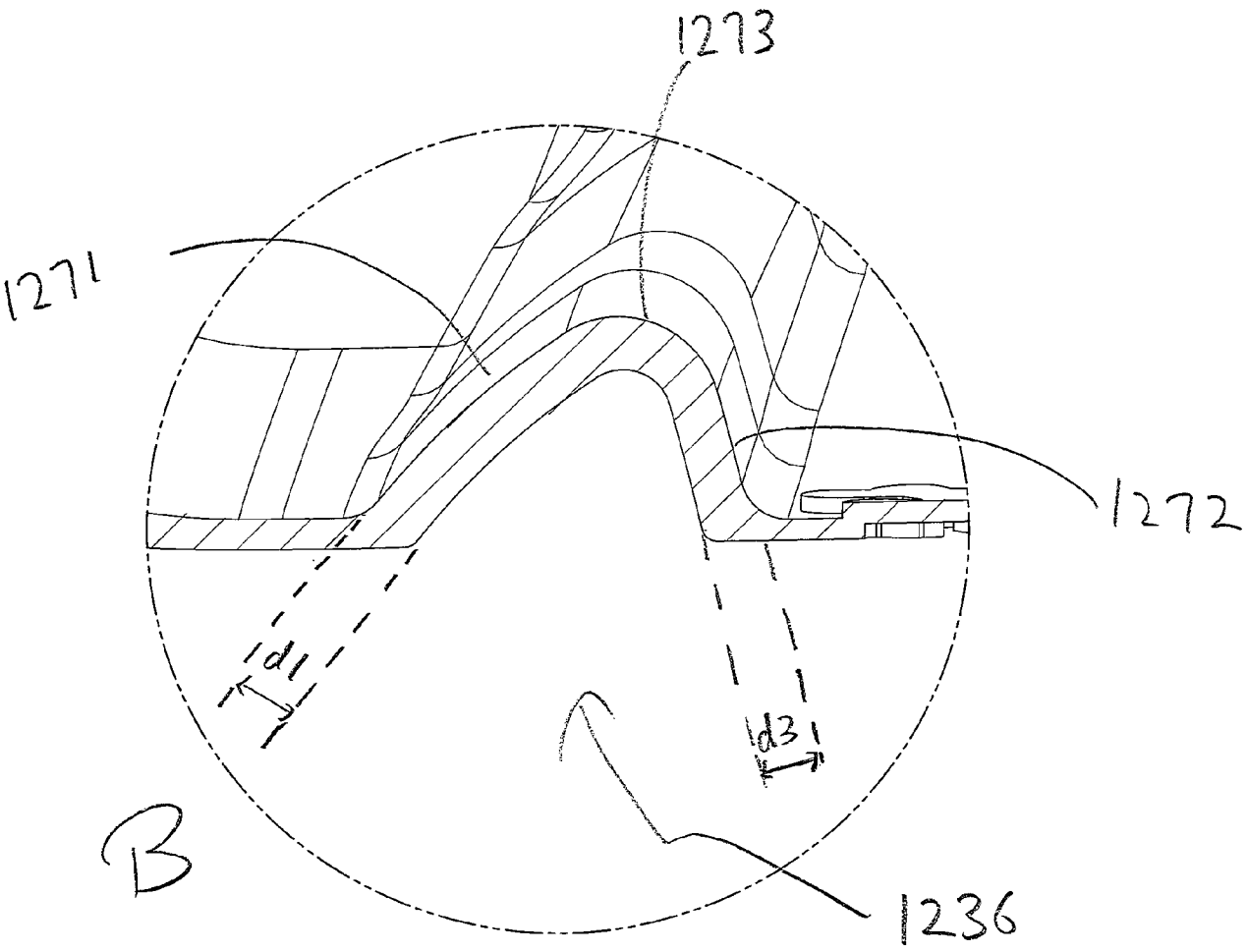

FIG. 13 shows an enlarged cross-sectional view of circular region B shown in FIG. 12 to allow the specific features and thickness of the flexure 1236 to be shown more clearly. The flexure 1236 shown in FIG. 13 is different from the flexure 1036 shown in FIG. 11 in that flexure 1236 has a thicker front wall 1271, a slightly thicker rear wall 1272, and the thickest portion of the flexure 1236 does not occur at the apex 1273. More specifically, the front wall 1271 shown in this embodiment of the present invention may have a thickness d1 of greater than about 1.30 mm, more preferably greater than about 1.40 mm, and most preferably greater than about 1.50 mm. The rear wall 1272 shown in this embodiment of the present invention may have a thickness d3 of greater than about 1.20 mm, more preferably greater than about 1.30 mm, and most preferably greater than about 1.40 mm. It should be noted that in this embodiment of the present invention, due to the fact that the front wall 1271 has increased in thickness, the apex 1273 is no longer the thickest portion of the flexure 1236, but rather the apex 1273 now serves as the transition of changing thickness between the front wall 1271 and the rear wall 1272.

Figure 14:
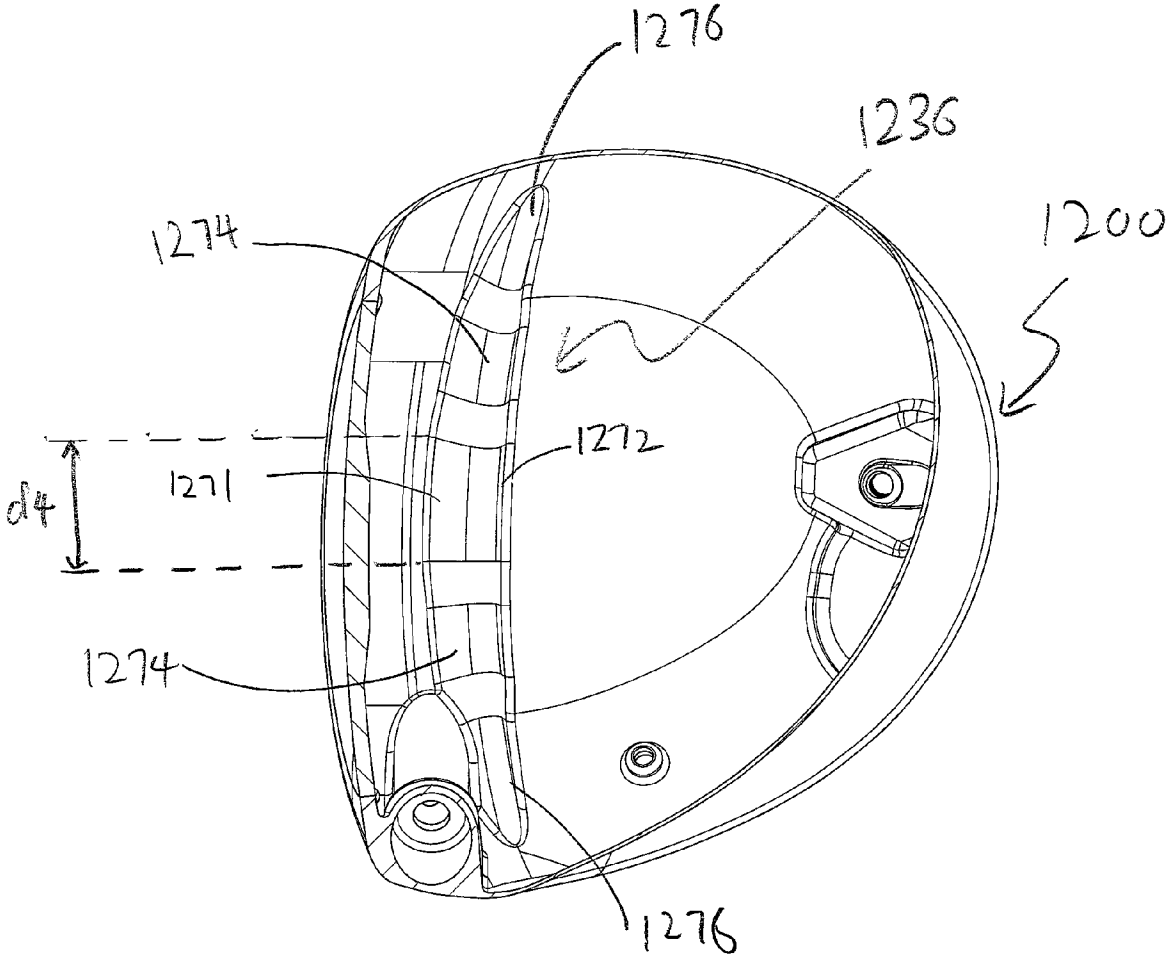

FIG. 14 shows a cross-sectional view of the golf club head 1200 along a plane that is perpendicular to the striking face, allowing the entirety of the flexure 1236 to be shown along the heel to toe direction. In this cross-sectional view, it can be seen that the front wall 1271 and the rear wall 1273 thicknesses does not stay constant along the entire length of the flexure 1236 in the heel and toe orientation. In fact, in this alternative embodiment of the present invention, the front wall 1271 and the rear wall 1272 thickness are only controlled in the central portion having a distance d4 of about 20 mm. Keep in mind that the central portion may not be placed exactly at the geometric center of the striking face, as the location of the highest stress can often occur at a location that is slightly offset from the geometric center of the striking face. In this embodiment of the present invention, the central portion may be placed at a location that is about 9.0 mm toe-ward from the geometric center of the striking face.

The present embodiment of the present invention, in order to reduce the wall thickness of the flexure 1236 at portions that do not experience high stress, slowly reduce the wall thickness as the flexure 1236 moves away from the central portion of the flexure 1236. The wall thickness at the intermediate transition regions 1274 may generally be thinner than the wall thickness at the rear wall 1272, while the wall thickness at the outer transition regions 1276 is generally even thinner than the wall thickness at the intermediate transition region 1274. More specifically, in this current embodiment of the present invention, the front wall 1271 may generally have a thickness of between about 1.50 mm to about 2.0 mm, more preferably between about 1.60 mm to about 1.90 mm, and most preferably between about 1.65 mm to about 1.85 mm. The rear wall 1272 in accordance with the present invention may generally be thinner than the front wall 1271, and have a thickness of between about 1.20 mm to about 1.70 mm, more preferably between about 1.30 mm to about 1.60 mm, and most preferably between about 1.35 mm to about 1.55 mm. The intermediate transition region 1274 may generally be slightly thinner than the rear wall 1272 and have a thickness of between about 1.10 mm to about 1.60 mm, more preferably between about 1.20 mm to about 1.50 mm, and most preferably between about 1.25 mm to about 1.45 mm. Finally, the outer transition region 1276 may generally be even thinner than the intermediate transition region 1274 and have a thickness of between about 0.80 mm to about 1.10 mm, more preferably between about 0.85 mm to about 1.05 mm, and most preferably between about 0.90 mm to about 1.00 mm.

Based on the above, it can be said that the flexure 1236 may generally have the thickest portion located at the front wall 1271, next thickest region located at the rear wall 1272, followed by the intermediate transition region 1274, and the thinnest wall thickness occurs at the outer transition region 1276.

In a preferred embodiment of the present invention, the thickness variations of the various portions of the golf club head, including the striking face and the flexure region, may generally be achieved by simply thickening up the wall thickness. However, in an alternative embodiment of the present invention, the different thickness variations could be achieved via an internal weight pad, an external weight pad, or any other types of features that can be used to alter the thickness of the walls all without departing from the scope and content of the present invention.

It is important to note that a flexure is not the only golf club head feature than can alter the flex characteristics of the golf club head when impacting a golf ball. Other features, which may include for example, wall thicknesses, curvature, ribbing, weight ports, hosel structure, etc., can asymmetrically affect the stiffness of a golf club head and thus effect the location of a sweet spot on the striking face of the golf club head. The various embodiments of variable thickness profile as well as shifted thick central portions discussed herein can be utilized to complement a plurality of golf club head features in addition to the flexures discussed herein.

In another embodiment, a golf club head can be formed from a plurality of pieces which are joined together to form the golf club head. In some embodiments, the sole portion and striking face can be formed from one integral part utilizing a technique called super plastic forming. Super plastic forming is performed at high temperatures, and sometimes in a vacuum, to achieve larger than conventional elongation in a material during the formation process. The process is especially attractive in the processing of titanium materials. In some embodiments, a pressurized gas can be used in place of a male die to form a part rather than a physical die contacting the surface of the material during deformation. A pressurized gas can apply a more uniform force while minimizing localized friction which leads to the formation holes in the material. Super plastic forming can allow for more complex geometries to be formed. Super plastic forming also allows for little to no spring back, aiding in accuracy of manufacture. Additionally, unlike a casted material, a sole and striking face formed with super plastic forming has no alpha case or presence of oxygen on the surface, minimizing surface imperfections, creating a smooth surface, and minimizing stress crack propagation. In some embodiments, various features such as the flexure and variable thickness profile discussed above could be produced using the super plastic forming process, including for example, the striking face, the sole, the flexure, and the variable thickness profile.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

We claim:

1. A golf club head comprising:

a striking face;

a posterior body comprising a crown portion and a sole portion, wherein said crown portion is coupled to an upper end of said striking face and said sole portion is coupled to a lower portion of said striking face;

wherein said sole portion further comprises a flexure spaced from said striking face, said flexure further comprising;

a central portion, located near a geometric center of said striking face;

a plurality of two or more intermediate transition regions, located nears a toe portion and a heel portion of said central portion; and a plurality of two or more outer transition regions, located near a toe portion and a heel portion of said plurality of two or more intermediate transition regions;

wherein said central portion further comprises, a front wall, a rear wall, and an apex, and wherein said front wall has a wall thickness greater than a wall thickness of said rear wall, said rear wall has a wall thickness greater than a wall thickness of said plurality of two or more intermediate transition regions, and said plurality of two or more intermediate transition regions has a wall thickness greater than a wall thickness of said plurality of two or more outer transition regions.

2. The golf club head of claim 1, wherein said wall thickness of said front wall is between about 1.50 to about 2.0 mm.

3. The golf club head of claim 2, wherein said wall thickness of said front wall is between about 1.60 mm to about 1.90 mm.

4. The golf club head of claim 3, wherein said wall thickness of said front wall is between about 1.65 mm to about 1.85 mm.

5. The golf club head of claim 2, wherein said wall thickness of said rear wall is between about 1.20 mm to about 1.70 mm.

6. The golf club head of claim 5, wherein said wall thickness of said plurality of intermediate transition regions is between about 1.10 mm to about 1.60 mm.

7. The golf club head of claim 6, wherein said wall thickness of said plurality of outer transition regions is between about 0.80 mm to about 1.10 mm.

* * * * *